US005947093A

United States Patent [19]

Ward

[11] Patent Number: 5,947,093

[45] Date of Patent: Sep. 7, 1999

[54] HYBRID IGNITION WITH STRESS-BALANCED COILS

[75] Inventor: Michael A. V. Ward, Lexington, Mass.

[73] Assignee: Ignition Systems International, LLC., Arlington, Mass.

[21] Appl. No.: 08/969,037

[22] Filed: Nov. 12, 1997

Related U.S. Application Data

[63] Continuation-in-part of application No. PCT/US94/12866, Nov. 8, 1994

[60] Provisional application No. 60/049,747, Jun. 12, 1997, and provisional application No. 60/063,507, Oct. 15, 1997.

[51] Int. Cl.[6] ..... F02P 3/08; F02P 15/08

[52] U.S. Cl. ..... 123/598; 123/604; 123/620; 123/637; 123/169 EL

[58] Field of Search ..... 123/169 EL, 596, 123/598, 604, 620, 623, 634, 637, 643, 655, 656, 605

[56] References Cited

U.S. PATENT DOCUMENTS

| | | | |
|---|---|---|---|
| 4,677,960 | 7/1987 | Ward | 123/598 |
| 4,688,538 | 8/1987 | Ward et al. | 123/598 |
| 4,733,646 | 3/1988 | Iwasaki | 123/598 |
| 4,774,919 | 10/1988 | Ward | 123/598 |
| 4,841,925 | 6/1989 | Ward | 123/598 |
| 4,922,883 | 5/1990 | Iwasaki | 123/598 |
| 5,056,496 | 10/1991 | Morino et al. | 123/604 |
| 5,131,376 | 7/1992 | Ward et al. | 123/598 |
| 5,193,515 | 3/1993 | Oota et al | 123/604 |
| 5,207,208 | 5/1993 | Ward | 123/598 |
| 5,220,901 | 6/1993 | Morita et al. | 123/620 |
| 5,456,241 | 10/1995 | Ward | 123/598 |
| 5,517,961 | 5/1996 | Ward | 123/598 |

*Primary Examiner*—Willis R. Wolfe
*Attorney, Agent, or Firm*—Jerry Cohen

[57] ABSTRACT

An improved high energy high efficiency hybrid capacitive/inductive ignition system with one or coils Ti for internal combustion engines employing one or more energy storage capacitor means (4) shunted by diode means (9), with high leakage inductor means **(3*a*) of coils Ti with which have their primary (1*a*) and secondary (1*b*) windings wound side-by-side on a single segmented bobbin 72**, unidirectional switches Si for each coil Ti which are preferably IGBTs, and high efficiency shunt diode/switch means SDi for each coil Ti shunting the primary winding of each coil Ti, so that, following production of an initial quarter cycle capacitive spark with peak current in the 0.2 to 3 amp arc discharge range, there is a decaying inductive unidirectional flow-resistant spark flowing through shunt switch means SDi.

72 Claims, 8 Drawing Sheets

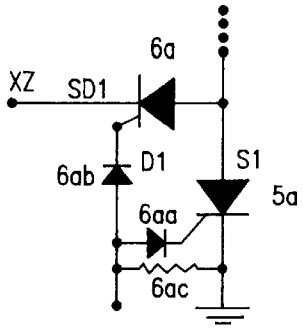
FIG. 8a
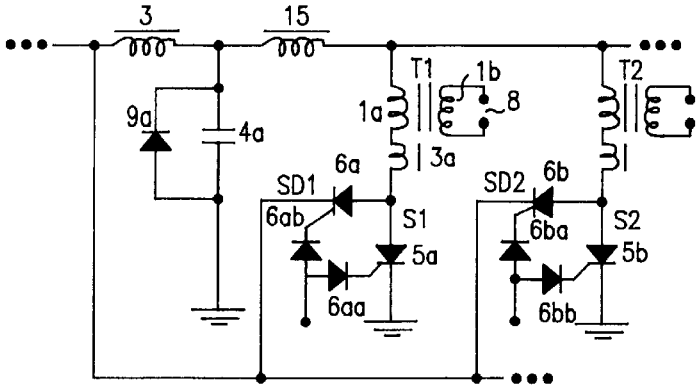
FIG. 8b
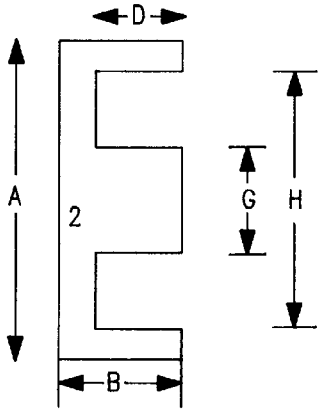
FIG. 9a
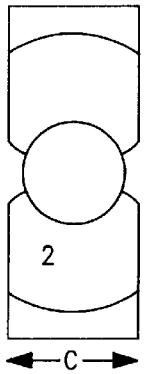
FIG. 9b
| | inches | cms |
|---|---|---|
| A | 2.0 | 5.1 |
| B | 0.8 | 2.0 |
| D | 0.5 | 1.3 |
| l=2•D | 1.2 | 3.0 |
| C | 0.75 | 1.9 |
| G | 0.7 | 1.8 |
| H | 1.50 | 3.8 |
| W=(H−G)/2 | 0.4 | 1.0 |
FIG. 9e
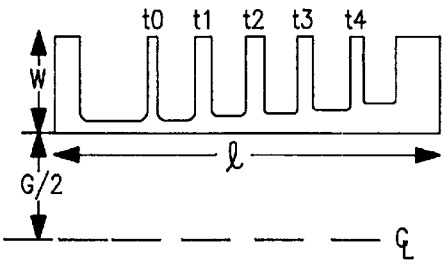
FIG. 9c
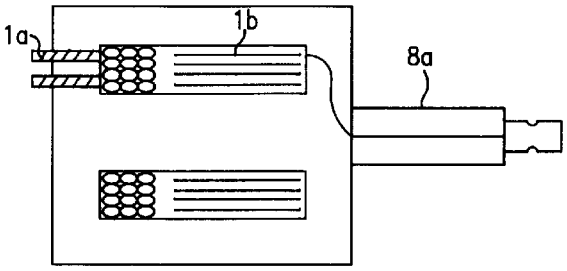
FIG. 9d

HYBRID IGNITION WITH STRESS-BALANCED COILS

CROSS-REFERENCE TO RELATED APPLICATIONS

This application is a continuation-in-part of PCT application No. PCT/US94/12866 (international filing date Nov. 8, 1994, designating the U.S. and other countries) and claims the benefit of U.S. provisional patent applications, numbers 60/049,747, filed Jun. 12, 1997, and 60/063,507, filed Oct. 15, 1997. Priority of all said applications, to the extent of common subject matter is claimed herein.

FIELD OF THE INVENTION

This invention relates to capacitive discharge (CD) ignition systems for internal combustion engines, and more particularly to improved CD ignitions with much higher (in comparison to other CD systems) spark energy and circuit efficiency, and with spark discharges which are highly resistant to breaking-up in the high flows found in the cylinders of modern high output engines. Preferably, the invention uses ignition coils with side-by-side windings for relatively high leakage inductance for the number of primary winding turns for higher coil efficiency and more equal magnetic stressing of the core of the coil, and in part on the use of controllable switches and shunt diodes for controlling and shaping the discharge of the energy storage capacitors (also referred to hereinafter as "discharge capacitors").

BACKGROUND OF THE INVENTION AND PRIOR ART

The present invention relates to ignition systems for internal combustion (IC) engines, and particularly to high power, high energy ignition simplified by the use of hybrid ignition features with ideal magnetic stress-balanced coils. High energy ignition is essential to the operation of IC engines using difficult-to-ignite mixtures, such as lean mixtures, high exhaust residual or high EGR mixtures, and the more difficult-to-ignite alcohol fuel mixtures. Such mixtures require hundreds of watts of igniting power and fifty millijoules or more of energy versus the ten to thirty watts and millijoules supplied by conventional ignitions. The simplified high power high energy hybrid ignition with stress-balanced coil disclosed herein can deliver the required power and energy with a minimization in the size and cost of parts to make the system practical.

The ignition disclosed is usable in the simpler distributor form or in a distributorless ignition form usable with separate leakage inductance disclosed in U.S. Pat. Nos. 5,315,982 and 5,131,376. The high power, high energy, stress-balanced minimum coil size features disclosed are based on Maxwell's equations used in conjunction with voltage doubling disclosed in U.S. Pat. No. 4,677,960 and its improvements which were first laid out in U.S. Pat. No. 5,315,982. U.S. Pat. Nos. 4,688,538, 4,774,914, 4,841,925, 4,868,730, and 5,207,208 may also be relevant to other features of the invention. The use of laminated cores for side-by-side winding coils and IGBT switches are discussed in detail in U.S. patent application Ser. Nos. 06/049,747, filed Jun. 12, 1997, and 06/063,507, filed Oct. 25, 1997.

All said above cited patents are of common assignment with this application and all include Dr. M. A. V. Ward as a sole or joint inventor. Reference to the above cited patents is sometimes made by simply listing the last three numerals of the number, as in patents '982, '376, '960, '538, '914, '925, '730, and '208. All are incorporated herein by reference as though set out at length herein.

Current capacitive discharge (CD) ignition systems are very inefficient, with typically 15% to 25% efficiency, and deliver typically only 20 to 30 millijoules (mJ) of spark energy per single spark pulse (into an industry standard 800 volt Zener load), whereas certain evidence points to a requirement of over 100 mJ of spark energy for best engine performance. In addition, CD ignition coils are typically wound with concentric primary and secondary windings to give relatively low leakage inductance for a given number of primary wire turns, which contributes to the low efficiency of the ignition system, versus the two to three times higher efficiency of 50% to 60% of the system disclosed herein.

In this application, a system is disclosed including factors such as flow resistance of the spark discharge that enables a more optimum range of leakage inductance Lpe, leakage resistance Rpe, and peak currents is for standard passenger vehicle and racing applications. Also disclosed is systems for more optimal use of the magnetic core of the coil which is achieved with side-by-side windings and judicious choice of coil winging shape and wire turns.

CD ignitions have traditionally used silicon control rectifiers (SCRs) as the main switching element controlling the discharge of the energy storage capacitors which typically have very high peak primary currents of tens of amps to over one hundred amps. Use of SCRs has the limitation of requiring full discharge of the energy storage capacitors and relatively slow restart of the power supply which recharges the capacitors. In this application is disclosed the use of insulated gate bipolar transistors (IGBTs) in conjunction with high efficiency shunt diodes and novel control circuitry to achieve controlled turn-off of the capacitor discharge process to leave some charge on the capacitors and provide rapid restart and recharging of the capacitors. The system also reduces the required size of the power supply by as much as a factor of two, especially important in high speed engine operation.

Current CD ignitions, particularly those used in racing and performance, use resonant type charging of the discharge capacitors which produces large current spikes on the battery line, as large as 20 amps in some cases, to compromise other vehicle electronic systems. On the other hand, power supplies with low ripple current are preferred, as has been disclosed in U.S. Pat. No. 5,558,071. Their operation is improved by not allowing the discharge capacitors to fully discharge as is disclosed herein.

There is therefore an advantage to improved CDI systems, both distributor and distributorless one-coil-per-plug type, which can deliver high spark energy of 100 to 250 mJ with high energy delivery efficiency of 50% to 60% (battery to spark gap efficiency). The systems preferably employ coils with side-by-side windings for low resistance and ease of manufacture. Moreover, the invention specifies the magnetics of the ignition coil and associated circuitry to make best use of the available core magnetic area and magnetic materials to achieve a more (magnetic) stress balanced condition. Also, the systems are designed to provide optimum peak spark current in terms of the best trade-off between igniting ability and spark plug erosion, as is disclosed herein.

SUMMARY OF THE INVENTION

The present invention is an improved CD ignition system with coils that have side-by-side windings for greater stress balance and efficiency and that produce ignition sparks in the arc discharge mode characterized by spark currents in excess of 200 ma which have a higher flow resistance than the low current spark operating in the glow discharge mode (typically 20 to 100 ma). The spark shape is typically essentially triangular which helps increase flow resistance. In the two preferred embodiments, the spark current is characterized by a peak spark current in the transitional arc discharge mode of 200 to 800 ma and in the high arc current mode of 1 to 3 amps for even greater flow resistance. In the disclosure that follows, the high current mode is a higher frequency mode that typically uses ferrite cores for the coils. For the moderately high transitional arc discharge the frequency is low and uses silicon iron (SiFe) laminated cores, although SiFe can also be used in the higher frequency higher current range. In the description that follows, the higher current case is disclosed first, which emphasizes the use of external resonating inductors; the moderately high current case disclosed next emphasizes no need for external inductors.

An object of the present invention is to achieve high power high energy ignition with arc mode spark current lasting for a sufficient time duration to deliver many tens to a hundred or more millijoules (mJ) of spark energy to the air-fuel mixture to insure the ignition of difficult to ignite mixtures.

A further object of the invention is to provide suitable switches for the ignition circuit and to insure reliable turn-off of the switches which are SCRs in one case and which do not have a negative bias imposed during turn-off as a result of the unidirectional decaying inductive current.

Another object of the invention is to optimize and balance the ignition parts size and cost with the spark discharge size and the spark plug erosion. A consequence of the present hybrid ignition (combined capacitive and inductive system) is the production of a hybrid arc/glow discharge wherein the initial spark of one quarter period is of high frequency and high current followed by a long duration, 0.5 to 5 msec, lower frequency linearly decaying inductive spark of lower spark current which can also be in the ampere range or in the hundred milliampere range of the glow discharge which can provide good quality ignition with a large spark gap while reducing spark plug erosion and spark plug insulator fouling and enhancing combustion reactions through its high spark burning voltage.

One preferred embodiment of the present invention that meets the above objects is a system that features a capacitive type ignition system using novel magnetic stress-balanced coils with a high leakage inductance used in conjunction with novel hybrid capacitive-inductive discharge ignition of the voltage doubling, arc discharge, high power/high efficiency type. The stress balance feature of the coils, i.e. approximately equal maximum coil core magnetic flux density during the peak voltage open circuit and peak current short circuit conditions, is achieved by using closely located side-by-side windings on an E-core (versus concentric windings) in conjunction with other coil and circuit features to achieve the stress-balance. The preferred hybrid ignition feature, characterized by a capacitive first quarter period sinusoidal spark discharge in the 0.3 to 3 amp range peak spark current followed by a decaying unidirectional inductive spark discharge current of period of order of magnitude of one millisecond, is brought about by including high efficiency high current diodes across the discharge capacitors and/or primary coil winding. Such operation involves the elimination or preferably the relocation of the shunt diodes and/or shunt switches across the main discharge switch Si (i=1, 2, . . . ) controlling the ignition coil firing, resulting in a system with decaying Kettering type inductive spark for most of the spark duration but with much higher spark current resulting in far greater igniting capability compared to Kettering ignitions.

Such ignition, designated as "hybrid ignition", i.e. hybrid capacitive and inductive ignition, typically includes a DC to DC converter and controller to charge up one or more discharge capacitors. The ignition circuit may also include resonating leakage inductor means and stress-balanced coils. Two discharge capacitors and resonating inductors may be used comprising a higher and lower discharge frequency circuit separated by an isolation diode to allow for minimum sizing of the compact (preferred stressed-balanced) coils whose high initial open circuit frequency is determined by the higher frequency circuit. The higher frequency discharge circuit controlling the initial spark discharge may be viewed as an auxiliary discharge circuit to the main lower frequency discharge circuit of the "dual discharge circuit". The spark discharge time of about one millisecond, which is easily varied over a wide range with design, permits simplified spark firing control for the ignition system.

The energy is preferably delivered by a toroidal gap plug, as disclosed in the prior patents cited, with spark plug tips preferably made of low erosion material such as tungsten-nickel-iron, platinum, etc. The plug tip is well heat-sunk and designed to minimize fouling by keeping the spark discharge away from the plug insulator by recessing the insulator. The recessed insulator may also provide an relatively large spark plug interior combustion volume for further reducing fouling and also for enhancing combustion reactions. Such enhancement can be implemented through electric field enhancement from the high spark burning voltage associated with the glow spark discharge, or through coating of the metallic surfaces of the plug interior combustion volume and the outer plug ends in contact with the engine combustion chamber with catalyst material such as palladium oxide, or by using both electric field and catalyst enhancement.

There are other objects to the invention relating to its application with the moderate arc currents in the range of 200 to 800 ma where laminated cores are used for the coils with preferably no external inductor.

An object of the invention wherein peak spark currents are in the range of 200 ma to 800 ma is to deliver high spark energy of about 100 mJ or higher (assuming a single spark discharge except when otherwise specified) and provide a compact coil and very high overall ignition system battery to spark efficiency of 50%. The energy as stated above is assuming a 800 volt Zener load.

A further object is to controllably turn-off the main ignition firing switches, accomplished in part by the use IGBT switches, or other switches that can be turned-off while conducting current.

A further object is to use voltage versus current sensing with simple comparator based control circuitry for control of the IGBTs.

A further object is to obtain coil primary inductance Lp which is at least ten times greater than the leakage inductance Lpe, preferably approximately 20.

A further object is to provide a good trade-off between high output voltage of approximately 40 kV and high spark current. This is accomplished by designing the secondary Ns to primary Np winding turns ratio N (N=Ns/Np) be approximately 60 for 400 volt rating discharge capacitors charged to approximately 350 volts Vc, and appropriately scaled for other capacitor voltage rating and voltage Vc usage.

A further object is to use higher values of discharge capacitors than the typical 1 uF used in most niche market applications, i.e. racing and performance, marine, etc., preferably in the range of 2 uF to 5 uF for energy storage of 100 mJ to 300 mJ and for realization of voltage doubling, especially when used with coils with low output capacitance achieved with bobbins with segmented or sectioned compartments for winding the secondary turns.

A further object is to provide coils with primary leakage inductance Lpe between 100 and 800 uH, preferably approximately 300 uH, and low leakage resistance Rpe with a ratio of Rpe/Lpe less than 1.5 mΩ/uH at 1 kHz, or quality factor Qpe of above 5 at 1 kHz, preferably approximately 10 or greater.

Another embodiment of the present invention that meets the above objects for the moderately high current arc discharge is a system designated ICDI (for improved CDI) which operates at a peak spark current of 200 to 800 milliamps (ma), versus about 50 ma or about 2 amps, and preferably has a peak spark current of 400 ma to 600 ma, and uses coils with side-by-side windings whose cores are preferably SiFe laminated cores (or other low cost high flux density material) which are efficient at the low frequencies which are used, and have a high saturation magnetic flux density Bm of approximately 2 Tesla (typically usable to 1.6 Tesla). Preferably, the laminations are interleaved to give high primary inductance Lp and high primary to secondary winding coupling.

A relationship has been determined for the leakage inductance Lpe of the coil with side-by-side windings to preferred geometries and sizes of the coils to provide leakage inductance Lpe of 200 to 400 microhenry (uH) with a relatively low coil primary turns Np of 40 to 60, preferably Lpe of approximately 300 uH for Np of approximately 55 turns with preferred peak core magnetic flux densities of 1.0 to 1.6 Tesla. Also, the leakage inductance Q at 1 kHz, defined as Qpe, where Qpe=W·Lpe/Rpe where W is the angular frequency (at 1 kHz), is designed to be greater than 5, preferably approximately 10 or greater.

As used herein, "approximately" means within ±25% of the term it qualifies. The term "about" means between ½ and 2 times the term it qualifies.

Preferred forms of distributor and distributorless circuits are disclosed, as well as a preferred coil with side-by-side winding and housings for such coils. The circuits employ shunt diodes to produce preferred flow resistant triangular distribution spark current, although that is not essential for the coil design. For the case of SiFe laminated cores, the entire circuit (leakage) inductance is made up exclusively of the coil leakage inductance Lpe for the most compact and efficient design. Where low spark currents are required, e.g. 200 ma to 300 ma, external inductors may be included, as disclosed.

Designs of two types of circuit topologies for CDI, designated Type I for the distributorless version (more than one coil) and Type II (one coil) are disclosed, which conventionally use SCRs as the main switching elements. For these two topologies is disclosed use of IGBT switches instead of the SCRs to controllably turn off the discharge of the capacitor energy when most of the stored energy is discharged, e.g. when 80% to 90% of the energy is discharged (with the primary current subsequently flowing through the shunt diodes). This leaves a significant voltage on the capacitor, e.g. 20% to 40% of the initial voltage, which allows for quicker restart of the power converter and more rapid recharge of the capacitor by methods disclosed, especially by the preferred low ripple, high efficiency, flyback power converter used herein to raise the battery voltage to a preferred approximately 350 volts to charge the energy storage capacitors. Simple types of voltage versus current sensing methods are disclosed for turning off the IGBT to give more precise and reliable control.

Other features and objects of the invention will be apparent from the following detailed description of preferred embodiments taken in conjunction with the accompanying drawings.

BRIEF DESCRIPTION OF THE DRAWINGS

FIG. 8*a* is a drawing of an SCR based dual switch S1/SD1; FIG. 8*b* is a partial circuit drawing of FIG. 4 showing the dual SCR switches of FIG. 8*a*.

FIGS. 9*a* to 9*d* are cross-sectional views of a core, bobbin, and complete ignition coil of a preferred stress-balanced coil; FIG. 9*e* is a table of preferred values of dimensions of the stress-balanced coil of FIG. 9*d*.

DESCRIPTION OF PREFERRED EMBODIMENTS

Figure 1:
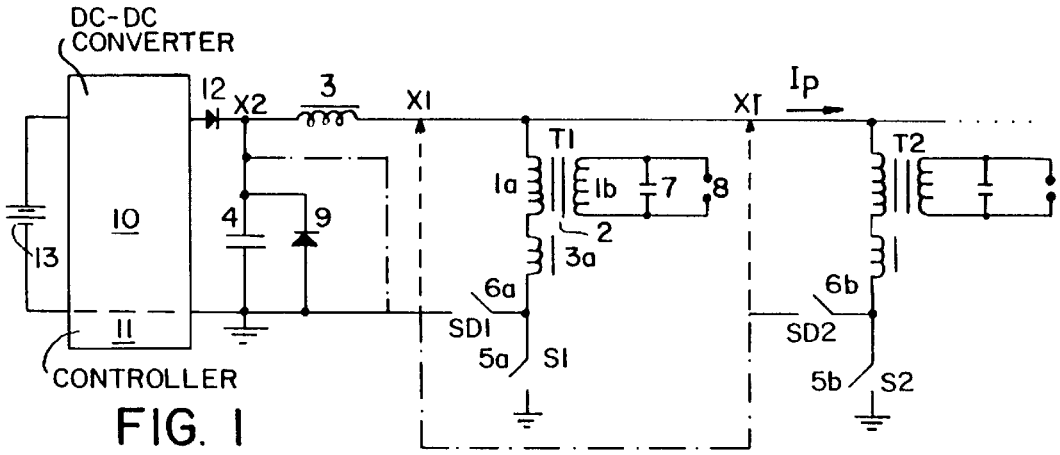
FIG. 1 is a circuit diagram, partially block diagram and partially detailed circuitry, of a generic form of the hybrid ignition for multi-cylinder engines with a single discharge circuit and with preferred high leakage coils shown as applied to a distributorless ignition system.

FIG. 1 is a circuit diagram, partially block diagram and partially detailed circuitry, of an embodiment of a distributorless version of the hybrid ignition system depicting two of "n" number of parallel cascaded ignition coils T1, T2, . . . Tn, each comprised of a primary winding 1*a,* secondary winding 1*b,* and magnetic core 2. The symbol Ti will be used to designate an arbitrary coil, i.e. the "ith" coil, of an arbitrary number of "n" coils. The coils T1, T2, . . . Tn, are part of a spark discharge circuit including a resonating inductor 3 (Le0), energy storage and discharge capacitor 4 (C), main discharge switches S1 (5*a*), S2 (5*b*), . . . Sn, for the coils T1, T2, . . . Tn, which, with the coil primary windings 1*a* comprise a primary discharge circuit.

Figure 2:
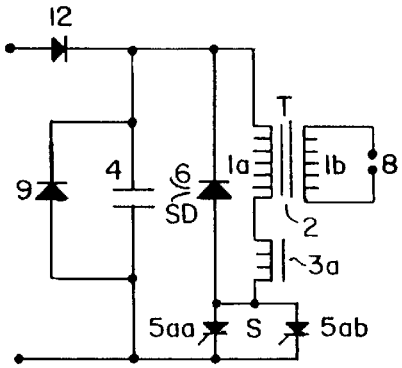
FIG. 2 is a circuit drawing of the discharge circuit portion of a preferred distributor version of the ignition of FIG. 1 with the entire leakage inductance integrated into the coil of a preferred stress-balanced coil.

The primary discharge circuit preferably includes the generic shunt diodes/switches SD1, SD2,... SDn, which may comprise shunting switches, or clamp shunt diodes (as they shall be referred to) as shown in FIG. 2, which have their anodes connected to the anodes of switches Si and have their cathodes connected to include either the primary coil winding 1*a* (and its leakage inductance 3*a*) by connection to point X1, or the resonating inductance 3 by connection to point X2, where the alternative connection to point X1 is shown as a dashed line and the connection to point X2 is shown by a dashed-dotted line. If shunt diodes/switches SDi are employed then the initial part of the primary discharge current will flow through switches Si and the later part through shunt diodes/switches SDi for greater efficiency.

For each coil there is defined a secondary circuit comprising the coil secondary winding 1b and the output capacitance 7 (Cs) and spark gap 8. Discharge capacitor 4 has a high efficiency, high current diode 9 across it defining a part of the hybrid feature of the ignition.

To charge the discharge capacitor 4, a DC to DC converter 10 is provided with its controller 11 and an output diode 12 for charging capacitor 4 to a high positive voltage, typically approximately 400 volts or other convenient voltage determined by the application and by the voltage rating of available components. The term "approximately" as used throughout this application means within plus or minus 25% of the value it specifies. The power converter 10 is connected to a battery 13, although power supply 13 can be any electrical (DC) power supply depending on the application. For simplicity, the automotive application is assumed, employing a 12 volt car battery. Any variety of energy sources 13 and power converter charging systems 10 can be employed in this hybrid ignition.

The circuit operates when a switch Si (one of 5*a,* 5*b,* . . . ) of coil Ti is closed, resulting in the flow of initial open circuit high frequency "fs" current in the primary and secondary circuits which charges the output capacitor 7 at the frequency fs (designated f20 in this case of FIG. 1) to a high peak voltage Vs (of typically 30 to 45 kilovolts (kV) maximum in the present application as applied to passenger car engines or the like) which subsequently breaks down the spark gap 8. Following spark breakdown, the energy stored in capacitor 4 discharges at a frequency f10 of typically 5 kHz to 30 kHz determined by the value of capacitance C of capacitor 4 and the total circuit inductance Le, i.e. sum of of inductance Le0 of inductor 3 and the primary leakage inductance Lpe of the coil Ti whose switch Si has been activated.

$$f10=1/[2*pi*SQRT(C*Le)] \quad (1)$$

where pi=3.142, "*" indicates multiplication, and SQRT indicates the square root of the quantity it qualifies, and Le=Le0+Lpe.

Figure 1A:
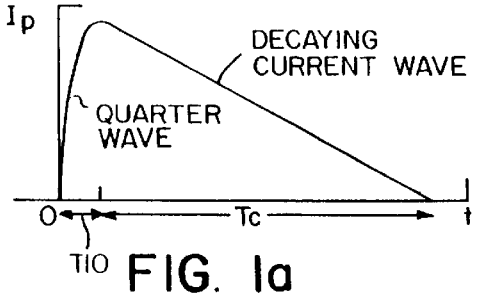
FIG. 1*a* is a graph of the primary circuit discharge current flowing as a function of time corresponding to the single discharge circuit of FIG. 1.

Capacitor 4 discharges for a quarter period T10 (T0=1/f10) as shown in FIG. 1*a* until diode 9 becomes forward biased (capacitor 4 is discharged). Thereafter, diode 9 holds capacitor C at essentially zero volts with the stored electrical energy now residing in the resonating inductance Le0 (3) and Lpe (3*a*). The current Ip in the inductance decays essentially linearly with time with a time period Tc as shown in FIG. 1*a,* which is derived to be approximately:

$$Tc=[I1(0)*Le]/[Vdp+Vr+Vds/N]=[Vc*SQRT(Le*C)]/[Vckt] \quad (2)$$

where I1(0) is the peak current in inductor 3, Vc is the initial voltage on the discharge capacitor 4, Vdp is the total switch (e.g. Si) and diode (e.g. diode 9) voltage drops in the primary circuit, Vr is the sum of the average voltage drops of the resistances of inductor 3 plus that of the coil primary winding 1*a* and its secondary winding 1*b* reflected into the primary circuit, Vds is the spark discharge voltage drop, Vckt=Vdp+Vr+Vds/N, and N is the coil winding turns ratio N=Ns/Np, where Np and Ns are the primary and secondary winding turns.

For a distributorless ignition application where low leakage, concentrically wound coils are assumed, or for the distributor ignition case of FIG. 2 where the leakage inductance Lpe is entirely in the coil (a form of stress-balanced coil):

Vc=360 volts, C=5 microfarads (uF)

Ec=½*C*Vc2=325 mj, where Ec is the energy stored on the discharge capacitor 4 and "" represents exponentiation.

Le0=20 microhenries (uH), Lpe=1 uH; or Le0=0, Lpe=21 uH

I1(0)=Vc/Ze=Vc/SQRT[(Le)/C)=175 amps

Vdp=3 volts average, typically between 2 and 5 volts,

Vds/N=4 volts average, where Vs=100 volts to 600 volts or greater depending on spark conditions and N is approximately 60 for a discharge voltage Vc of approximately 400 volts (and otherwise inversely proportional to Vc).

T10=64 usecs, f10=16 kHz

Tc=360*SQRT(21*5)/7 microseconds (usec)=500 usecs

The spark discharge time of approximately 0.5 millisecond (msec) is in the range of 0.25 to 5 msecs, the preferred spark discharge time for a high speed engine. Typically, Vds is inversely proportional to engine speed, i.e. the spark burning voltage increases with speed induced turbulence.

One can vary the spark discharge time Tc and stored energy Ec by selecting different values of Le and C. For example, doubling Le to 40 uH and C to 10 uF would double Tc, raising it to 1 millisecond and would also double the stress on the magnetic core components of the circuit as will be discussed.

The open circuit (high voltage) magnetic flux density B2(x) and the peak closed circuit (spark firing) magnetic flux density B1(0) (or B10) in the core 2 of a coil Ti are derived from Maxwell's equations and are introduced below in a more generic way that takes into account the case of any number of (in-series) inductances in the circuit from which the definition of "stress-balance" for a coil can be made, where we designate as Lj any circuit inductance and Le the total circuit inductance, where:

Le=Sum of Lj for j=1, 2, . . . m.

Figure 4:
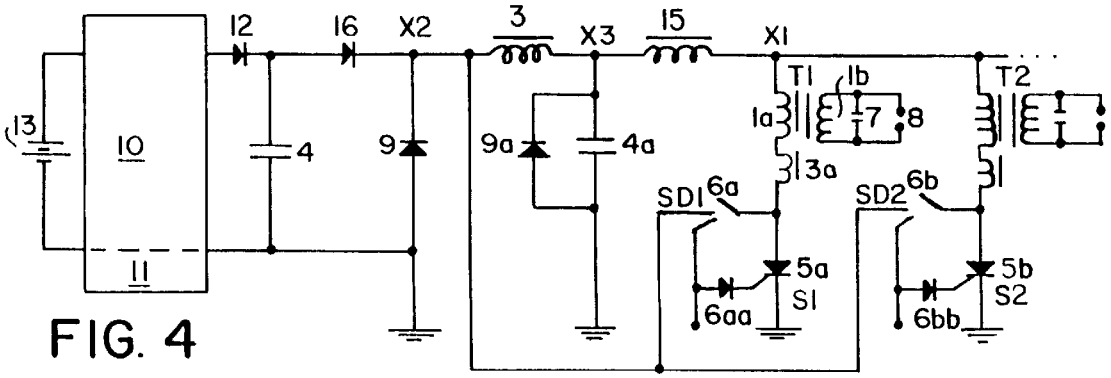
FIG. 4 is a preferred embodiment of the circuit of FIG. 1 which includes two discharge circuits, the lower frequency circuit and the supplementary high frequency circuit for minimizing the size of the coils, and preferred main switches Si and shunt switches SDi, all as mentioned above and showing their preferred location.

For the circuits of FIGS. 1, 2, and 4 respectively:

Le=Le0+Lpe; Le=Lpe; Le=Le0+Le1+Lpe, where Le1 is inductance 15 of the auxiliary high frequency circuit of the dual circuit of FIG. 4 which will be disussed presently.

Starting with B10j, the peak spark firing flux density in inductor Lj:

$$B10j=[Vc/(UF*2*\mathrm{pi}*f10*Aj*Nj)]*[Lj/Le] \quad (3)$$

where Aj, Nj are the core area and number of winding turns respectively of the inductor Lj, and UF is the unity factor designed to equal approximately 1:

$$UF=1+DF \quad (3a)$$

$$DF=(N**2)*Cs/C \quad (3b)$$

where DF is called the (voltage) doubling factor and is preferably designed (where practical) to be equal to approximately 0.1.

Designating as B10 the peak flux density in the coil, we obtain:

$$B10T=B10*[Lpe/Le] \quad (3c)$$

$$B10=[Vc/(UF*2*\mathrm{pi}*f10*Ap*Np)] \quad (3d)$$

where B10T designates B10 in a circuit that includes other inductances.

The open circuit flux density B2(x) at a time t of x(t) in a coil is:

$$B2(x)=B10*\mathrm{SQRT}(DF/UF)*[Le/Lpe]*[Ap/As]*[x-\sin(x)] \quad (4)$$

$$x(t)=2*\mathrm{pi}*fs*t \quad (4a)$$

$$fs=f10*\mathrm{SQRT}(UF/DF) \quad (4b)$$

where x(t) is the open circuit (high voltage) phase angle, fs is the open circuit frequency, and Ap and As are the core cross-sectional areas on which the primary and secondary windings of turns Np and Ns respectively are wound. If we take DF to have the practical design value of 0.11, then:

$$\mathrm{SQRT}(DF/UF)=1/\mathrm{pi},$$

and if we take the preferred value of x, designated as x0, to be 155 degrees (150 to 160 degrees), which we define as the "peak" open circuit magnetic flux density B2(0), or B20, corresponding to 0.95 or [1−cos(x0)]/2 of the peak open circuit voltage Vs, then we can write:

$$B20=B10*[Le/Lpe]*[Ap/As]*f(x0) \quad (4c)$$

$$f(x0)=[x0-\sin(x0)]/\mathrm{pi},\ 2/3<f(x0)<pi/4 \quad (4d)$$

where the two limits represent values of 150 and 160 degrees for x0.

We can now define the "stress balance" criteria as:

B20=B10, with B10 satisfying some peak designated value, $$f(x0)=(Lpe/Le]*[As/Ap] \quad (4e)$$

which is a principal result of this disclosure leading to the development of two types of stress-balanced coils. "Stress balance" assumes the same core material for the core sections on which the primary and secondary windings are wound.

For ferrite cores a peak design value of B10 is approximately 4 kiloGauss (kGauss), the core saturation flux density Bsat at approximately 80 degrees C.

For the previously defined automotive application with circuit parameters:

Vc=360 volts, C=5 uF, Le=20 uH, f10=16 kHz, B10=4 kGauss, a preferred design is a core size of approximately 1 square inch and a number of turns of approximately 12 for a single inductor making up inductance Le.

As already mentioned, for the case of a distributorless ignition with low leakage inductance coils, i.e. Lpe<<Le0, the case not of interest since stress balance is not employed by definition, these values, i.e. approximately 1 square inch and 12 turns respectively, are a preferred design for the separate resonating inductor 3 if it were made of ferrite material. This case is also not of interest since it would requires relatively large coils Ti relative to that of FIG. 4 where a dual frequency, i.e. low and high frequency, circuit is used with stress-balanced coils for minimum size of the coils Ti.

However, for the distributor ignition case of FIG. 2 where the circuit inductance is integrated in primary inductor 3*a* of the coil T the present analysis is of interest. This application represents a form of stress-balancing of the coil in which Lpe=Le, and hence stress-balance is achieved through unequal sizing of the core sections on which the primary and secondary windings are wound, $$f(x0)=As/Ap,$$

with f(x0) taken to correspond to the 160 degree limit, i.e. f(x0)=pi/4.

Figure 2A:
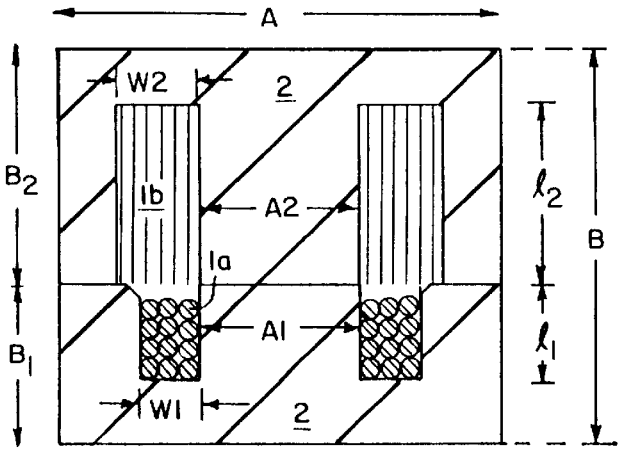
FIGS. 2*a* and 2*b* are approximately to-scale side and top views of the preferred stress-balanced coil.

FIG. 2 is a circuit drawing of a preferred embodiment of a distributor version of the hybrid ignition with the leakage or resonating inductor 3*a* integrated into the coil T. The high leakage is achieved by employing a side-by-side winding of the primary 1*a* and secondary 1*b* windings as shown in FIG. 2*a*. Like numerals represent like parts with respect to the earlier figures. In this embodiment two parallel SCRs are shown for the main discharge switch S which can be fired simultaneously or sequentially to reduce the load on the SCRs. Since the leakage (resonating) inductor Lpe (3*a*) is integrated into the coil and supplies the entire required inductance, no separate resonating inductor Le is required. For shunt diode/switch SD a high efficiency diode 6 is used which shunts the entire primary winding (connection to point X1 as per FIG. 1).

FIG. 2*a* is an approximately to-scale side-view drawing of a preferred stress-balanced coil for the present automotive application with the following assumed, above introduced, approximate values of discharge circuit parameters:

C=5 uF; Le=20 uH; Ne=12; Vc=350 volts

For this case the core dimensions (ferrite core) are given approximately as:

A=3 inches; B=2½ inches; B1=1 inch; B2=1½ inches;

I1=⅝ inch; I2=1⅛ inch; W1=⅜ inch; W2=½ inch;

A1=A2=1 inch

A1 is a side of a square core and A2 is a diameter of a round post so that the cross-sectional area represented by A2, i.e. As, is pi/4 of that represented by A1, i.e. Ap, satifying the condition of stress balance (with Lpe=Le):

As/Ap=pi/4=f(x0)

The voltage doubling factor DF is taken as approximately 0.11 in the analysis of the stress balance equation. This places a constraint on the value of the total output capacitance Cs, which should be no greater than approximately 160 pf for N=60, C=5 uF. Such a total capacitance is easily attainable even in the case with long, capacitive spark plug wires or preferred capacitive plugs. A lower value of total output capacitance Cs lowers the value of B20 relative to B10 as can be seen by including the doubling factor DF explicitely in the analysis:

$$B20=B10*[Le/Lpe]*[Ap/As]*f(x0)*\mathrm{SQRT}[0.1*DF/UF] \quad (5)$$

which leads to the more general stress balance equation:

$$f(x0)=[Lpe/Le]*[As/Ap]*\mathrm{SQRT}[0.1*UF/DF] \quad (5a)$$

With regard to the leakage inductance value Lpe it was experimentally determined that a primary winding of twelve primary turns in three layers (FIG. 2*a*) naturally provides the required leakage inductance of approximately 20 uH. Taken with C=5 uF, DF=0.1, C=5 uF, the following values are obtained for the two frequencies and the open and closed circuit magnetic flux densities:

f2=50 kHz; f10=16 kHz; B20=B10=4.2 kGauss, to provide an optimized stress-balanced design of a simple coil design with an essentially square primary core and a round, cylindrical secondary core for easy winding of the approximately sixty times greater turns of the secondary winding (i.e. of approximately 720 turns).

Figure 2B:
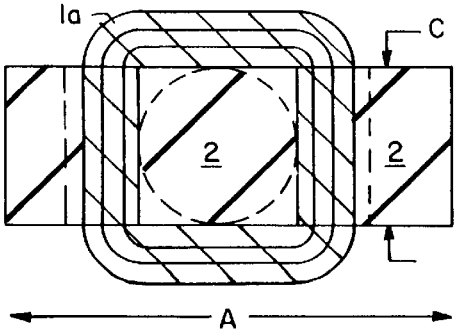

FIG. 2*b* shows a top view at the interface of the two core sections of FIG. 2*a* of thickness C equal to A1 and depicting the dimensions of the secondary core section in broken curves and the primary core dimensions in solid lines. Note that if a higher voltage or larger discharge capacitor is employed then the core dimensions can be scaled up accordingly. Also, the wider the primary winding channel Wi the smaller the leakage inductance Lpe, the higher the frequencies f10 and f20, and the lower the peak magnetic flux densities B10 and B20. That is, this side-by-side winding coil design is stable against adjustments in core area Ap (and As) since changing the core area Ap changes the channel width W1 inversely and the inductance Lpe proportionally in a way to maintain approximately constant peak magnetic flux densities B10 and B20.

Before considering the distributorless hybrid ignition with stress-balanced coils a form of ignition circuit with integrated power supply is disclosed.

Figure 3:
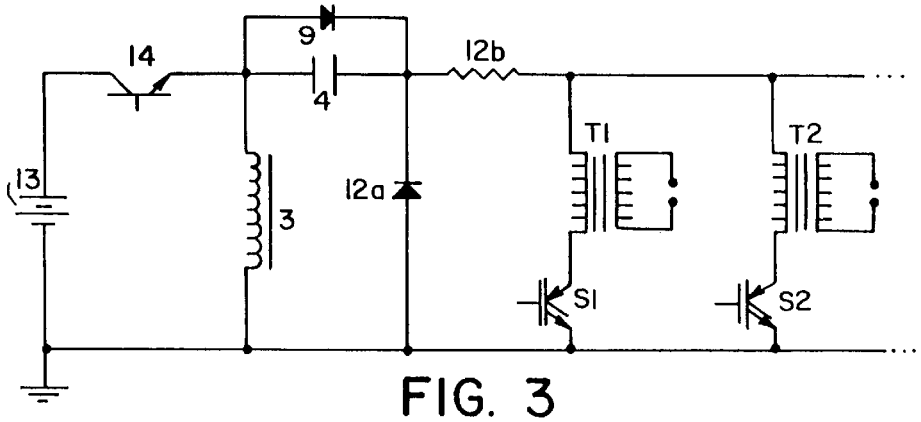
FIG. 3 is a circuit drawing of an embodiment of a hybrid, capacitive-inductive ignition with integrated DC to DC converter power supply.

FIG. 3 depicts an integrated hybrid capacitive/inductive ignition system (without recharge circuit), where a single inductor 3 is used for both the power converter stage and for the ignition discharge stage as disclosed in the integrated converter patent '208. Like numerals correspond to like parts with respect to earlier figures. By using diode means 9 across the discharge capacitor 4, then the discharge current (and spark) is a DC current as in conventional, low cost Kettering type ignition, except in this case the ignition has much greater power and is more efficient. Such DC ignition does not require a diode in series with the switch 14 as in patent '208 (except possibly for a low voltage Schottky diode) or a shunt diode across the discharge switch Si (S1, S2, shown), shown as an IGBT in this case (which can also be an SCR).

During power converter operation, energy is stored in the inductor 3 when switch 14 is on, and delivered to capacitor 4 through diode 12*a* when the switch is turned off. During spark firing, switch Si is turned on, and the discharge current rises sinusoidally at a frequency f1' to a maximum in a quarter period (when voltage across capacitor 4 is zero) and then decays exponentially with a time constant L/R, where L is inductance of inductor 3 and R is the equivalent resistance 12*b* of the discharge circuit, which is typically about 0.2 ohms for a well designed system. Inductance L typically ranges between 20 uH to 200 uH, the smaller value allowing for higher open circuit discharge frequencies, and hence smaller sizes of the coils T1, T2, . . . Assuming a 400 volt system, then for L and C equal to about 100 uH and 3 uF respectively, the power converter and discharge circuit will operate at a frequency of about 10 kHz. It is emphasized that the ignition circuit disclosed in FIG. 2 is simple and low cost, as is the case of the Kettering ignition, but in this case is much more powerful, efficient, effective, and easier to control, allowing for peak spark currents in the amp range which decay to constitute a hybrid arc/glow spark discharge.

Figure 5:
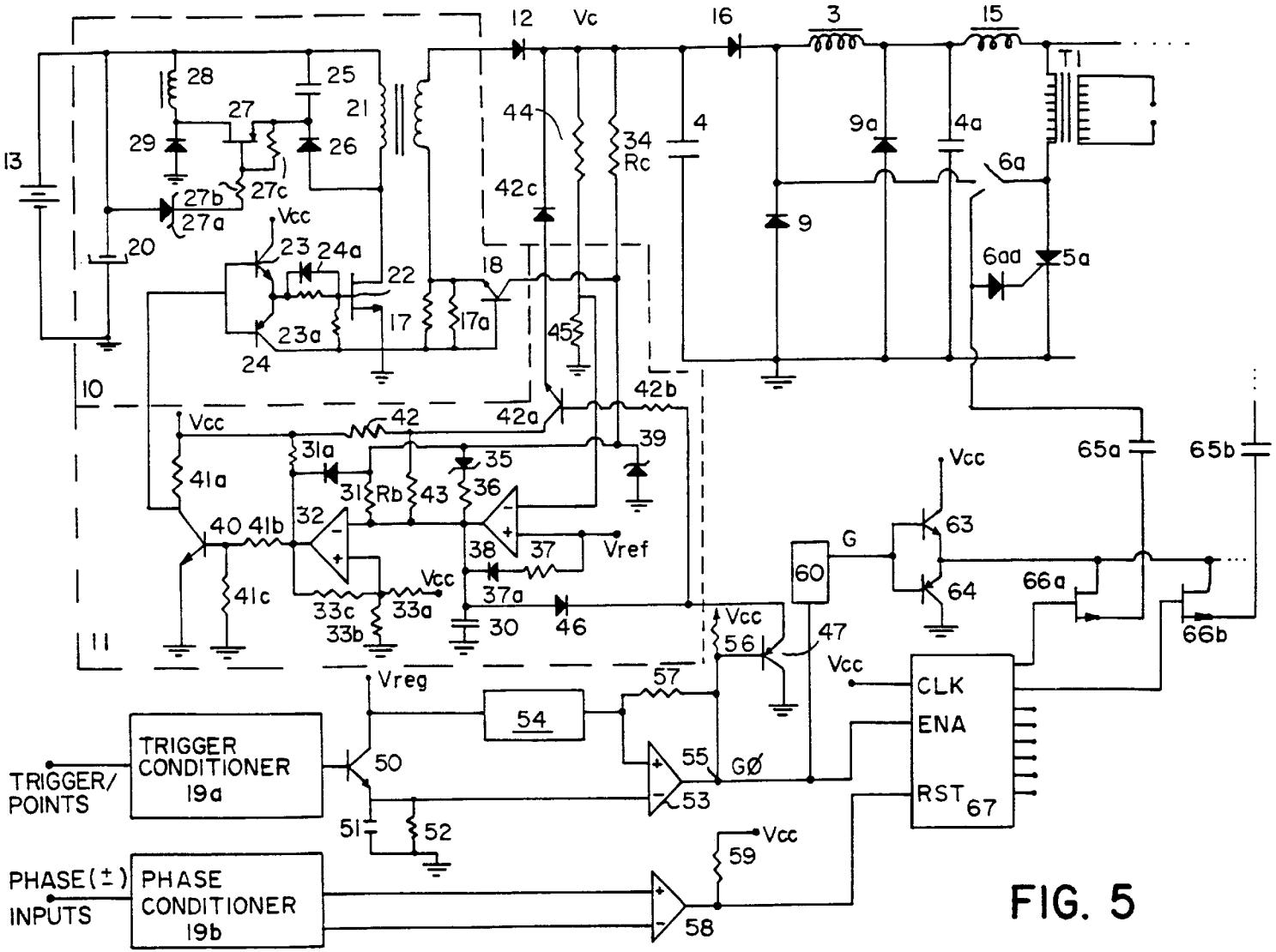
FIG. 5 is an essentially complete circuit drawing of a preferred embodiment of a distributorless version of the hybrid ignition (using FIG. 4 features) including details of a preferred flyback power supply with further novel features of the power supply and of the overall control and operating system.

For the present application of the preferred embodiments of FIG. 2 (distributor ignition) and FIG. 4 (distributorless ignition) a flyback type power converter is preferred as will be disclosed with respect to FIG. 5.

FIG. 4 is a partially block, partially circuit drawing of a preferred embodiment of the distributorless ignition of FIG. 1 in which a dual discharge ignition circuit is provided by means of an auxiliary high frequency (HF) circuit comprised of a capacitor 4*a* (Cl), a shunt diode 9*a*, a resonating inductor 15 (Le1), and an isolation diode 16 isolating the main, lower frequency, discharge circuit of frequency f10 as per equation (1) from the high frequency auxiliary discharge circuit of frequency f3 defined as:

$$f3=1/\{2*\mathrm{pi}*\mathrm{SQRT}[C1*(Le1+Lpe)]\} \quad (6)$$

Like numerals represent like parts with respect to FIG. 1.

The high frequency auxiliary circuit is particularly simple in that it requires only a diode to isolate it from the main discharge circuit. In operation, when switch Si (of S1, S2, . . . ) is closed, capacitor 4*a* discharges through inductor 15 and the coil primary winding 1*a* at an initial open circuit frequency f4 which is higher than the main discharge open circuit frequency f20. For example, if f3 is approximately two times greater than f10, then so is f4 approximately two times greater than f20 since the open circuit frequencies f4, f20 are related to the closed circuit (spark firing) frequencies in approximately the same way according to:

$$f20=f10*\mathrm{SQRT}[(1+DF0)/DF0] \quad (7a)$$

$$f4=f3*\mathrm{SQRT}[(1+DF1)/\mathrm{DF}1] \quad (7b)$$

where DF0, DF1 are the voltage doubling factors given by:

$$DF0=(N**2)*Cs/C \quad (8a)$$

$$DF1=(N**2)*Cs/C1 \quad (8b)$$

In this analysis the ignition is operated in the preferred voltage doubling mode wherein the doubling factors are preferably less than 0.2, and preferably approximately 0.1.

The result of a higher open circuit frequency f4 is a proportionally smaller coil Ti core size, all other things being equal, as will be discussed with reference to FIGS. 6*a,* 6*b*. Preferred values for the circuit parameters for the main automotive application, assuming (small) ETD 54 cores for coils Ti, are:

C=3.6 uF; Le0=30 to 60 uH; Vc=350 volts

C1=2.3 uF; Le1+Lpe=15 to 18 uH where Le0 of 60 uH is achieved by winding approximately 20 turns of wire (Litz wire preferred) on a laminated EI-¾ core (core area ¾*¾, or 0.56, square inch) with preferably 7 mil laminations and with the "I" leg absent, i.e. an open core where precautions are taken that no large metallic material are within ¼" to ½" of the open end of the core.

Preferably, the high frequency inductance (Le1+Lpe) is obtained by using a stress-balanced coil with leakage inductance Lpe approximately 0.6 of the total inductance (Lpe+Le1). That is, turning to the stress balance equation (5a), and taking As equals Ap (the coil core on which the two windings are wound is uniform as in standard cores), we obtain for the stress balance condition:

$$Lpe/(Lpe+Le1)=f(x0)/\mathrm{SQRT}[0.1*UF/DF]$$

Assuming N=60 and Cs=60 pF, then DF=0.09, UF=1.09, leading to:

$$Lpe/(Lpe+Le1)=f(x0)/1.10$$

and taking the lower limit of f(x0), i.e. ⅔, we obtain:

$$Lpe/(Lpe+Le1)=0.6.$$

The other condition for stress balance is that the values B20, B10, which we will designate as B40, B30 respectively for the present preferred high frequency auxiliary circuit, are equal to 4 kGauss, e.g. 4.2 kGauss. These are satisfied if Lpe is made to equal to 10 uH for a primary turns Np equal to 11 turns for an assumed ETD 54 core, where the term "equal to" as used in this context means within plus or minus 10% of the value it specifies. These special values of Lpe and Np, and low value of Cs, are achieved by the coil designs of FIGS. 6*a,* 6*b* and will be disclosed there. The inductor 15 (Le1) provides the remaining small inductance of 6.5 uH required according to the above equation.

For the case where it is desirable to have a long spark firing period Tc an inductance Le0 of approximately 1.6 milliHenry (mH) can be used which is obtained by winding approximately 100 turns of 16 to 18 gauge wire, e.g. 17 AWG magnet wire, on an open EI-¾ laminated core. For a voltage Vd=10 volts, where Vd=Vdp+Vds/N, and an assumed coil resistance Rcoil of coil Le0 of approximately 0.2 ohms, comprising essentially the entire circuit resistance, the spark firing time constant Tc is approximately 2.4 msecs, using the more exact version of equation (2) given by:

$$Tc=\{ln[I(0)+(Vd/Rcoil)]/(Vd/Rcoil)\}*Le0/Rcoil \quad (9)$$

Figure 4A:
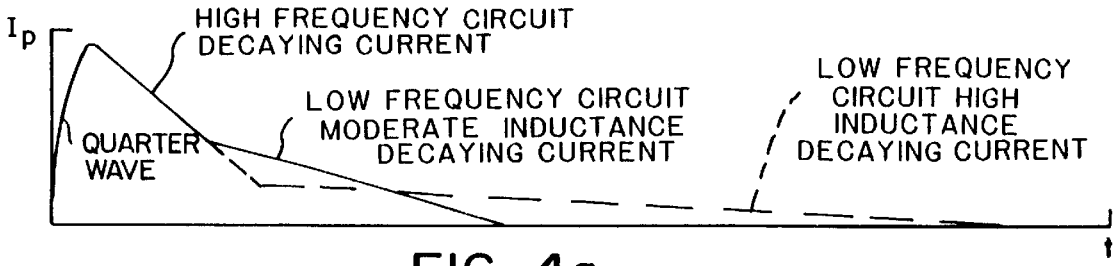
FIG. 4*a* is a graph of the primary circuit discharge current flowing as a function of time corresponding to the dual discharge circuit of FIG. 4.

In this application, the spark discharge current is made up of two distinct components as shown in FIG. 4*a* as the dashed curve, an initial arc component of approximately 2 amps peak current and of short duration of approximately 0.3 msecs, and a glow discharge spark current of approximately 250 ma peak with the long duration or discharge time constant Tc of approximately 2.4 msec. A longer time duration is achievable by increasing the inductance Le according to equation (9), e.g. by winding 160 turns of 18 AWG magnet wire on an EI-¾ open laminated core an inductance of approximately 4 mH is obtained and a time constant of approximately 3.6 msecs. Such a design (of long or even longer time constant Tc) can be of particular use for ignition systems of slow speed stationary gas engines.

Returning to FIG. 4 to complete the analysis of the circuit operation, it is noted that switches 6*a,* 6*b,* . . . , are employed for the shunt switches SD1, SD2, . . . , for the automotive case where the coils Ti are located close to each other, e.g. adjacent to each other, and the cathodes of the shunt switches are returned to the preferred location X2 which includes the main inductor 3 in the circuit. Note that for the case where inductance 3 is large, i.e. of the order of magnitude of 2 mH, i.e. between 0.2 and 20 mH, it may be simpler to return the cathodes of the shunt switches/diodes to location X1, i.e. across the primary windings of the coils, and use diodes, such as high efficiency Motorola MR2406 diodes having a low forward drop of approximately one volt at a high current of 50 amps or greater. This would be of particular interest where the coils Ti must be remote from each other as in large stationary gas engines.

When the ignition is fired, say switch S1 of coil T1 is turned on, and the discharge capacitors 4 and 4*a* complete their quarter cycle discharge and the electrical discharge energy is stored in the form of current in inductors 3 (Le0), 15 (Le1), and in the primary leakage inductance 3*a* (Lpe), the current can flow either in a circuit including the capacitor shunt diodes 9 and 9*a* with the switch S1 (5*a*), or in a circuit excluding switch S1 (5a) which is replaced by the corresponding shunt switch SD1 (6*a*). The path including the shunt switch SD1 is the preferred path since it represents only one forward drop versus two drops for the path including the capacitor shunt diodes 4, 4*a* and control switch S1 (SCR 5*a* shown). Essentially all the inductive current goes through the shunt switches SDi and very little through the SCR switches Si, reducing the electrical dissipation on the SCR switches Si and making for a more efficient operation. Note that a diode 6*aa* (6*bb* for switches 5*b,* 6*b*) may be required between the triggers of S1 (5*a*) and SD1 (6*a*), i.e. with its anode and cathode connected to the triggers of switches SD1 and S1 respectively as shown, to insure that the shunt switch of a non-firing switch (say SD2) is not inadvertently turned on during the firing of another switch pair, i.e S1 and SD1.

The preferred packaging of parts for the hybrid ignition is in two boxes: 1) a power box including the power converter 10 and controller 11, and 2) the coil assembly comprised of the inductors 3 and 15, the low and high frequency capacitors 4 and 4*a* and their shunt diodes 9 and 9*a* and the isolation diode 16, and the coils Ti with their switches Si and clamp shunt switches SDi, where i=1, 2, 3, . . . Preferably, coils Ti are stress-balanced coils as shown in FIGS. 6*a,* 6*b.* For the distributor ignition (FIG. 2) a single enclosure containing the entire ignition is both practical and preferred.

Note that in the analyses disclosed, the voltage doubling criterion was assumed. An alternative way to invoke the voltage doubling criterion is through a frequency criterion of requiring that the open circuit frequencies f20, f4 be approximately three times (between 2.25 and 3.75 times) greater than their closed circuit spark firing frequencies f10 and f3 respectively, i.e.

$$\mathrm{SQRT}[(1+DF)/DF]=3$$

where DF is a generalized voltage doubling factor.

FIG. 5 is a more complete more detailed circuit drawing of a preferred embodiment of a hybrid ignition system which includes control features for both the ignition and a preferred flyback power converter circuit shown. Like numerals correspond to like parts with respect to the earlier figures.

The ignition system shown is of the hybrid ignition type disclosed in FIG. 4. The power converter is comprised of circuit block 10 and the controller of circuit block 11. The trigger circuit assumes an arbitrary trigger input conditioner 19*a,* and the phase input assumes a phase conditioner 19*b* for providing cam-based phasing signals for the present case shown of a distributorless ignition. Circuits suitable for 19*a* and 19*b* for providing conditioning of the signals are known to those versed in the art.

The flyback power converter 10 includes input filter capacitor means 20 (for minimizing stray inductance), flyback transformer 21, which for a 100 watt application can be designed around an ETD-39 gapped core of 1¼ square cm core area, with 5 to 8 primary turns, with about 12 uH primary inductance, and a turns ratio of approximately 12 (assuming the main switching transistor 22 is a high efficiency 60 volt FET and the output voltage is approximately 360 volts, the preferred automotive case, and assuming the peak current through the transformer 21 primary winding is approximately 20 amps). The drive for FET switch 22 is provided by a transistor pair 23 and 24 to provide turn-on of FET 22 when a positive voltage is supplied to the bases of transistors 23, 24 to charge the gate of FET 22 through resistor 23*a,* and turn off FET 22 when the bases are pulled low and the FET gate is rapidly discharged (for minimum switching loss) through diode 24*a* and transistor 24.

For the snubber of the flyback a snubber capacitor 25 and diode 26 is used as is known to those versed in the art, except in this case a lossless (or low loss) snubber circuit is provided by means of transistor switch 27 and inductor 28 and diode 29. Zener 27*a* (e.g. a 20 volt zener) and divider resistors 27*b,* 27*c* control operation of FET 27. Preferably capacitor 25 is about 0.1 uF and inductor 28 is about 50 uH, where the term "about" as used throughout this application means between one half and twice the value it specifies.

The power converter controller 11 is based on charging a timing capacitor 30 (of capacitance Ct) from the output voltage Vc through a resistor 34 (resistor Rc) which provides a required decreasing charging time with increasing output voltage, defining an off-time Toff. The on-time Ton represents the discharging of capacitor Ct through a resistor 31 (of value Rb) connected to the output of a comparator 32 through an isolation diode 31*a*. The charging capacitor 30 is connected to the inverting input of a comparator 32, and the non-inverting input has a reference voltage obtained from the divider resistors 33*a,* 33*b,* 33*c* which make the non-inverting input flip between ⅓*Vcc and approximately ⅔*Vcc depending on whether the comparator output is low or high. The normally high output of the comparator timer 32 corresponds to the off-time (Toff) versus the usual on-time (Ton).

The comparator (32) timer oscillator circuit, i.e. the "Timer", can be designed to turn main switch 22 on and off with our without a DC current. Preferably, operation with DC is employed which is set by a sensor circuit comprised of the NPN sensor transistor 18, resistor 17 connected between the secondary winding of transformer 21 and ground, and temperature regulating thermistor 17*a* connected across resistor 17. The base of sensor transistor 17 is at ground and its emitter at the high side of resistor 17 of value about 0.5 ohms for the present application so that the transistor switches when its base-emitter voltage rises above 0.62 volts and the current through the secondary is above the threshold current Ith (of approximately 1.2 amps in this case). The collector of sensor transistor 17 is tied to the low side of the off-time resistor Rc (34) to divert timing capacitor 30 charging current when the sensor current rises above Ith to increase the off-time and stabilize operation.

The timing (charging) resistor 34 is connected at one end to the voltage node Vc and at the other end through a shunting zener diode 35 and small resistor 36 which shunt the other timing resistor 31 of resistance Rb. In operation, capacitor 30 is charged by voltage Vc through resistors 34 and 36 representing the off-time Toff, to raise the capacitor 30 voltage from ⅓*Vcc to approximately ⅔*Vcc. The "Timer" then switches, and capacitor 30 discharges (with on-time Ton) through resistor Rb to ⅓*Vcc.

Zener diode 39 is a voltage limiting diode of approximately 9 volts zener voltage which, in addition to providing over-voltage protection, provides a high battery voltage shut-off of the timer oscillator and of the power converter.

Since the "Timer" is operated in a reverse mode, an inverting output circuit is required, comprised of a NPN transistor 40 with its emitter to ground and its collector connected through pull-up resistor 41*a* to Vcc and its base connected to the comparator 32 output through a base resistor 41*b*. A base emitter resistor 41*c* is also included and output of comparator 32 is connected to Vcc via pull-up resistor 41*d.* Transistor 40 inverts the comparator oscillator timer output node and supplies current to the driver transistors 23, 24 of main FET switch 22. In this way, the power converter is provided with the required "on-time" drive for say 20 amps peak current, and with the required "off-time" drive as a function of the output voltage (and peak secondary current).

In this controller operation if Vc falls below approximately ⅔*Vcc the charging capacitor 36 can never charge up and the output stays low to provide a built-in low output voltage shut-off. For power converter start-up following spark discharge, the discharge capacitor 4 is charged in less than a millisecond to above ⅔*Vcc from the supply Vcc through resistor 42 and transistor 42*a* controllable by the ignition firing to keep it off during spark firing through turn-on of shut-off transistor 47 pulling base resistor 42*b* to ground. Shut-off transistor 47 holds timing capacitor 30 low through diode 46 during spark firing.

Power converter turn-on is also speeded up by partial charging of timing capacitor 30 directly through hysteresis resistor 37 (and diode 37*a*) and resistor 43, connected to Vcc, of value about one half of the charging resistor Rc.

Regulation of the output voltage Vc is controlled by comparator 38 whose inverting input is connected to a voltage divider made up of resistor 44 (e.g. 360 kOhms for 360 volts output) and resistor 45 (e.g. 5 kOhms for a 5 volt reference Vref on the non-inverting input of the comparator 38).

In FIG. 5 is shown an ignition trigger conditioner 19*a* which can be designed by those versed in the art to control ignition firing by converting any of a number of possible ignition trigger input signals into a well defined short trigger pulse which, in this case, is applied to the base of an NPN transistor 50 whose collector is connected to Vreg and whose emitter is connected to capacitor 51 (Csig) shunted by a timing resistor 52 (Rsig) defining a decay time constant Tsig. The emitter is connected to the inverting input of comparator 53 and the collector to a circuit block 54 designed to provide a variable signal with engine speed to the non-inverting input of comparator 53. The output 55 of the comparator is normally high through connection to Vcc through pull-up resistor 56 with resistor 57 acting as a hysteresis resistor. When an input trigger is received at trigger conditioner 19*a,* comparator output 55 is pulled low to GO, designated as the spark trigger "gate" G0, and modulated (reduced) with increasing engine speed by circuit 54, ranging from several msecs at low speeds to about 1 msec or less at high speed for typical automotive applications.

The comparator output 55 is indirectly connected to the power converter controller timing capacitor 30 through connection to base of shut-off transistor 47 to turn-off the power converter when the ignition is firing (output 55 is low), a preferred operating condition for the hybrid ignition which does not employ recharging of the discharge capacitors during ignition firing.

Finally, output 55 of comparator 53 is connected to an inverting stage 60 whose output G is connected to the bases of drive transistors 63 (NPN transistor with collector to Vcc) and 64 (PNP transistor with collector to ground). The emitters of transistors 63 and 64 are inter-connected and represent the drivers for the ignition triggering SCRs 5*a,* . . . , and shunt switches 6*a,* . . . , etc.

For a distributor system the drivers would be connected to a capacitor 65*a* (capacitance of order of magnitude 1 uF), producing a positive pulse to the trigger of the SCR on spark firing (beginning of gate G) and a negative pulse at the end of gate G. For a distributorless ignition (case shown) there is included steering (FET) switches 66*a,* 66*b,* . . . , whose gates are connected to the outputs of a spark steering counter 67 and whose inputs are connected to the comparator output 55 (G0) and to the phasing signal output of comparator 58 (connected to Vcc via a pull-up resistor 59) which resets the counter when a signal is received from the output of comparator 58. At every firing cycle of all the engine cylinders, a phase signal is received at the reset pin (RST) of counter 67 which resets the outputs to begin another complete firing cycle of a multi-cylinder engine employing a distributorless ignition.

While the initial high frequency discharge circuit (supplementing the main discharge circuit of the dual discharge circuit) was shown with reference to the distributorless ignition, it can also be included in the distributor ignition. Other combinations of high and low frequency circuits are possible to achieve a good balance between small core size, efficient circuit operation, and acceptable spark energy delivery. Also, other control strategies are possible, including, for example, using multiple paralleled SCRs with a distributor ignition which are triggered from a counter either individually or in pairs for application where unusually high energy and power is being delivered at a rapid firing rate as in high speed racing engines.

As already discussed, for the distributor ignition, a single enclosure containing the entire ignition is both practical and preferred. For the distributorless version there are several possibilities including having a coil assembly with the coils Ti and switches Si contained within it, and the discharge capacitors and resonating inductors nearby in a separate enclosure which may or may not include the rest of the ignition system.

In the disclosure of the ignition system of FIG. 4 designs were presented in which preferred stress-balanced coils were employed. Such preferred stress-balanced coils are disclosed with reference to FIGS. 6*a* and 6*b*.

Figure 6A:
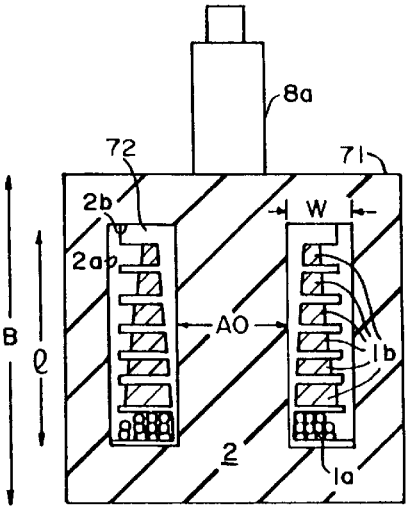
FIG. 6*a* is a schematic cross-section of a preferred moderately high leakage inductance stress-balanced coil with uniform core area.

FIG. 6*a* depicts an approximately to-scale partial schematic side-view drawing of a preferred stress-balanced coil 71 for the preferred dual discharge distributorless ignition of FIG. 4 (with coils Ti, i=1,2,3, . . . , ) employing a high leakage inductance ferrite E-core structure designed to have the required stress balance feature of equal open circuit peak magnetic flux density B40 and closed circuit flux density B30, equal to the saturation flux density Bsat of the core material 2 of, for example, 4.2 kGauss as disclosed with reference to FIG. 4.

For the present application is used a preferred more standard E-core such as the newly introduced ETD-54 core, with a center post diameter A0 of 0.75" (cross-sectional area Ap of 0.43 square inches or 2.8 square cms), a winding length "l" of approximately 1.5 inches and a window width "w" of approximately 0.43 inches, with preferred number of primary turns Np in the range of 10 to 12 and with a preferred turns ratio N of approximately 60. For an assumed separate leakage inductance 15 of value Lei of 5 to 8 uH a side-by-side primary 1*a* and secondary winding 1*b* must be used to obtain significant leakage inductance, i.e. higher leakage inductance Lpe than Le1 as derived in the stress balance criteria with reference to FIG. 4. A preferred doubling factor DF of approximately 0.1 was assumed to provide an open circuit frequency f4 approximately three times the short circuit frequency f3.

It is found that for the stress balance criteria, a side-by-side winding in which the secondary winding 1*b* is the conventional layer wound structure provides too high a leakage inductance and hence too high a short circuit flux density B30. That is, for a preferred 11 turns primary winding 1*a* the leakage inductance Lpe is 14 to 15 uH, which for a preferred capacitance C1 of 2.3 uF, inductance Le1 of 6.5 uH, and primary voltage of 350 volts gives a peak closed circuit flux density B30 of 6 kgauss, forty percent higher than the maximum allowable of 4.2 kGauss for ferrite cores. In addition, the conventional layer winding provides a relatively high coil output capacitance (Cs)coil.

Figure 6B:
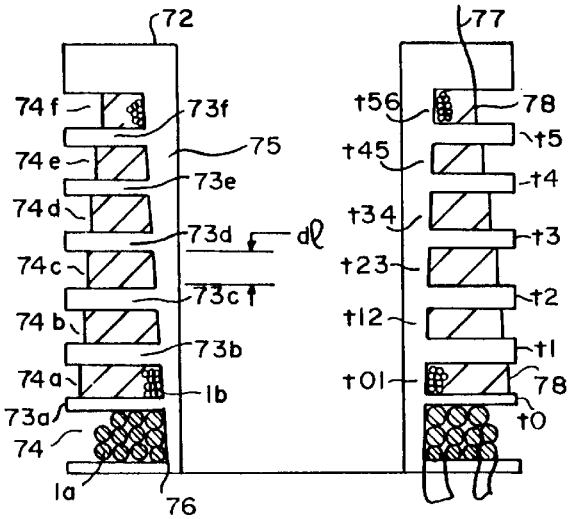
FIG. 6*b* is a schematic cross-section of a preferred bobbin for the coil of FIG. 6*a* for winding wire to provide the suitable moderately high leakage inductance.

This problem was resolved through the use of the compartmentalized secondary winding 1*b* of a bobbin 72, shown at approximately twice scale in FIG. 6*b,* in which the separation 73*a* (thickness "t0") between the primary and secondary winding is minimum, i.e. approximately 0.030 inches or less, versus approximately 0.20 inches. This reduces the leakage inductance Lpe from 14.5 uH to 11 uH, nearly the required forty percent to make for an ideal and practical design. Hence the use of the compartmentalized winding with a primary winding 1*a* of preferred 11 turns of Litz wire of approximately 0.10 inches diameter packed into three or four layers of primary compartment 74 about three times the size of the preferred six secondary winding compartments 74*a* to 74*f* which preferably use 30 gauge (28 to 32 gauge) heavy insulated magnet wire, with the whole structure encapsulated to withstand high voltage. In the preferred embodiment shown, the secondary compartment length "d1" is approximately 0.125" and the separations 73*b* to 73*f* have a progressively reduced thickness t1 to t5 of approximately 0.060 to 0.030 inches as do the turns per compartment Ni (i=1 to 6) which progressively drop from, for example, 160 to 60 in decrements of twenty turns per compartment for a preferred total number of secondary turns Ns of 660 for the preferred turns ratio N of 60 for 11 primary turns Np. Having the highest number of turns N1 adjacent to the primary winding 1*a* helps further reduce the primary leakage inductance to the required 10 uH for primary turns Np of 11. The bottom layer 75 of thicknesses tij, i.e. t01, t12, . . . t56, between the bottom of the secondary compartments and the inner diameter of the bobbin (the core surface) are also tapered, increasing from approximately 0.04" (t01) to approximately 0.10" (t56) to accommodate the progressively higher voltages of the secondary winding 1*b* which has its low voltage end 76 at the compartment 74*a* adjacent to the primary winding 1*a* and its high voltage end 77 (connected to the high voltage tower 8*a,* FIG. 6*a)* at the last compartment 74*f.*

The secondary winding is shown as cross-hatched layers where the progressively reduced windings N1, N2, N3, . . . , increase the margins between the top of the winding 78 in each compartment and the magnetic core surface to accommodate the progressively increasing voltage, with the last compartment 74*f* of turns N6 having margins of approximately 0.15" between the winding top surface 78 and the inner core sidewall 2*a* (FIG. 6*a*) and the inner core top wall 2*b* (FIG. 6*a*) to accommodate the preferred peak secondary voltage of approximately 36 kVolts. For the dimensions and core disclosed, the outside diameter of the bobbin 72 is approximately 1½", which for an inner hole diameter of ¾" makes the fin dimensions approximately ⅜ less the thickness tij.

For the six compartments shown and given dimensions and wire size the peak voltage between turns (the first and last turns of two consecutive layers in a given compartment) is approximately 1000 volts for 36 kVolt operation, or approximately 250 volts per mil for quad-coated magnet wire of thickness approximately 0.002 inches (2 mil thick). Employing more compartments, e.g. seven compartments of 0.10 inch size will reduce the electrical stress, which may be preferred although proper encapsulation of the entire coil should insure adequate voltage protection for six secondary compartments. The bobbin is slotted for communication between compartments as is well known to those versed in compartment windings, and for improved encapsulation.

Other advantages of the compartment winding is low secondary winding capacitance to provide a high open circuit frequency of 80 to 100 kHz for the preferred circuit and coil parameters disclosed above and in the disclosure of FIG. 4 to satisfy the stress balance criteria. Also, the bobbin structure 72 of the compartment winding simplifies large-scale manufacture (winding) of the coil.

In the preferred embodiment of the disclosure of FIG. 4 employing coils of FIGS. 6*a* and 6*b,* resonating inductances 3 is preferably approximately 50 uH for the preferred 350 volts Vc operating primary voltage, which with the other specified parameters produce peak short circuit primary Ip1 and secondary current Is of 120 amps and 2 amps respectively, where Ip1 is the higher frequency peak current through discharge of capacitor C1. The turns ratio N is varied depending on application but preferably not more than by 25% to maintain other required relationships. The cores for inductance L1 (15) can be a standard E625 ferrite gapped core; the core for inductance L0 (3) is preferably an open laminated core as already disclosed (an EI-¾ being preferred).

In the application where the coils must be remote and where no high frequency resonating inductor 15 is employed, a larger leakage inductance 3*a,* 3*b,* . . . , may be desired, e.g. 12 to 20 uH, but with the required lower ratio of leakage inductance Lpe to the number of primary turns Np of approximately one uH per turn as obtained with the coil designs of FIGS. 6*a,* 6*b.* To accommodate this, a somewhat larger core area (larger center post diameter A0) is required. For example, using the recently introduced ETD-59 core with core area of 3.65 cm square, a preferred design is one capacitor C1 per coil equal to approximately 2.5 uF and a primary turns Np of 12 or 13 for a leakage inductance of 13 or 15 uH respectively. The turns ratio N would preferably be higher, e.g. 66, for a higher 42 kV peak output required in the typical stationary gas engine application where such remote coils may be required.

It is to be noted that as an alternative preferred embodiment to the distributor ignition design of FIG. 2, a smaller E-core than that of FIGS. 2*a,* 2*b,* may be employed, having a uniform center winding post, e.g. an ETD-59 core or larger, according to the designs of FIGS. 6*a,* 6*b,* but with a separate resonating inductor 3 of small inductance less than the coil leakage inductance 3*a* (Lpe) to satisfy the stress balance criteria.

With regard to applications of FIG. 4 and 5 to large stationary gas engines running at constant speed, e.g. 300 RPM, it is noted that it is a relatively simple matter, known to those versed in the art, to place time delay circuits between the output of a firing sequencer device such as a counter 67, FIG. 5, to achieve variability in the firing of the switches S1, S2, . . . , of the coil discharge circuits relative to the trigger input signal that is received. In this way, variations in the burn or combustion time in different engine cylinders that often exist with large stationary gas engines can be accommodated by varying the time delays of the various cylinders to achieve peak pressure at equal piston positions with respect to engine top-center.

Figure 7A:
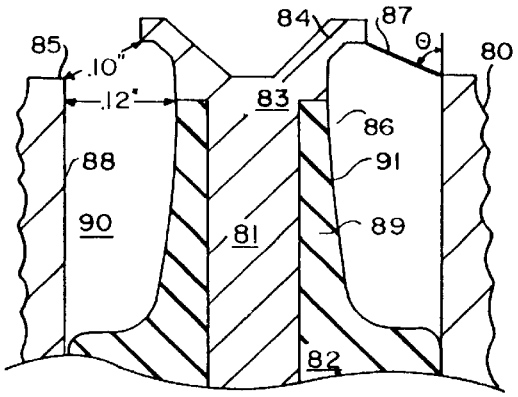
FIGS. 7*a,* 7*b* are side view cross-sections of the ends of the spark plug tips for use in the hybrid ignition, with the plug tips shown pointing vertically upwards versus downwards.

The high peak secondary spark currents in the ampere range require high erosion resistant and fouling resistant plugs as depicted in FIGS. 7*a,* 7*b.*

FIG. 7*a* depicts an approximately three times scale drawing of a side-view end section of a preferred toroidal or circular gap plug which may be useful with the present hybrid ignition. The plug has a threaded shell 80, center conductor 81, insulator 82, and a firing end 83 with upward and outwardly extended electrodes 84 which form an extended gap with the shell edge 85 (at an angle theta with the vertical of preferably 15 to 75 degrees) which is less than the gap formed with the horizontal, e.g. a 0.10" versus 0.12" gap as shown. This design reduces both erosion of the plug and fouling of the insulator end surface 86 by keeping the spark 87 away from it. For a 14 mm plug, the shell inner diameter is preferably a large 0.40" to accommodate the 0.12" gap shown between the insulator surface 86 and the inner surface 88 of the spark plug shell 80, making for a thin spark shell of only approximately 0.050" versus the conventional 0.1". The insulator end section 89 of the insulator 82 is extended far enough into the spark plug shell to define a large air volume 90 of sufficient length to minimize the possibility of tracking of the spark along the surface 91 due to fouling.

Figure 7B:
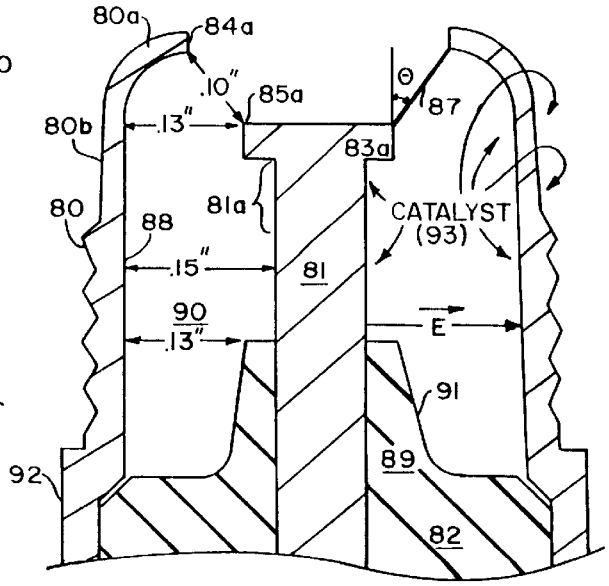

FIG. 7*b* depicts and alternative design of the plug of FIG. 7*a* with like numerals corresponding to like parts with respect to FIG. 7*a*. In this design, the end electrodes correspond more closely to a standard plug, the extended electrodes 84*a* comprise the tip of extended sections 80*a*, 80*b* of the shell 80 versus the center conductor 81 with the shell tip 84*a* forming a spark gap with an end section 85*a* of the end button 83*a* of the center electrode 81. The shell extensions 80*a*, 80*b* can be multiple electrodes or a continuous circular surface whose tip 84*a* makes an angle theta of preferably 15 to 75 degrees with the vertical. The actual angle theta selected will depend on the application. If the shell tip 84*a* defines a continuous essentially circular surface then preferably opening means are provided in the side of the shell extensions 80*a* to allow air-fuel mixture to flow through the plug end from side to side.

In the design of FIG. 7*b* (which can also be applied to FIG. 7*a*) is shown a recessed insulator section 82, 89, 91 which forms an unusually large air volume 90 of about 0.3" length and of radius approximately 0.15" (which can be larger for larger spark plugs such as 18 mm or larger plugs used in stationary gas engines). The insulator is shown extending from the larger diameter shell section 92 to achieve maximum recessing. Besides minimizing possibilities for fouling, the larger volume 90 defines a combustion volume which can be coated with a catalyst material 93 such as palladium oxide on all the inner metallic surfaces defining the large volume 90, i.e. surfaces 81*a* and 88, as well as the outer extended electrode surfaces 80*a* and 80*b* as shown to enhance the combustion reactions.

Besides, or along with, catalyst combustion enhancement within the spark plug, electric field enhancement can be employed by using the hybrid ignition with dual discharge circuits (FIG. 4) and selecting the main low frequency inductance L0 to be about 2 mH. This results in the maintenance of the maximum voltage across the volume 90 between the center conductor surface 81*a* and the inner shell surface 88 during the second low frequency spark discharge stage covering the spark current range of 50 ma to 200 ma (where the spark burning voltage Vds is maximum) for the major part of the spark duration. The voltage Vds is maximum for a spark current around 100 ma, in the range of 600 to 1,500 volts depending upon sparking conditions (gap size and mixture flow through gap), producing an electric field E of 1,600 to 4,000 volts per cm (for the radial dimension of 0.15" shown) which can enhance combustion reactions in the volume 90, especially near the inner electrode surface 81*a*.

There are many changes that can be made in the preferred embodiments disclosed within the inventive principles disclosed herein for the hybrid ignition with stressed-balanced coils.

For example, for the preferred coil of FIGS. 6*a*, 6*b*, a more compact coil core 2 with shorter winding length "l" is shown with reference to FIGS. 9*a* to 9*e* to give a somewhat lower leakage inductance Lpe, where the window length "l" is approximately 1.2" and the winding width "w" is approximately 0.4", and the bobbin is designed with fewer compartments, e.g. five compartments while still preserving the essential features already described for providing moderate leakage inductance Lpe of 10 uH for approximately 11 turns of primary winding Np to satisfy the stress balance criteria (open and closed circuit peak magnetic flux densities of comparable value near the saturation value Bsat). Also, other core materials can be used with different magnetic saturation values Bsat and accordingly modified to adhere to the inventive principles disclosed herein.

As another case, one can have a lower energy distributorless ignition, hybrid or not, in which only one capacitor means of value, say, 2.5 uF of 400 volt rating is used with no resonating inductors but larger coils with ETD-59 cores with side-by-side windings as in FIG. 6*a* with approximately 12 turns of primary winding.

Another case is to employ a single component for the dual switches Si and SDi since they share a common anode and trigger signal. Such a dual switch device Si/SDi is most easily made up of two SCRs and two diodes as shown in FIG. 8*a*. For the switch Si (shown as Si or 5*a*) an SCR is shown, as already disclosed, with a diode 6*aa* in series with its gate, and for the shunt switch SDi (shown as SD1 or 6*a*) another SCR is preferred shown with its anode connected to the anode of switch Si. In addition, a high voltage hold-off diode D1 (of Di for i=1), or 6*ab*, is required to prevent the cathode of the shunt SCR (SDi), which is connected to a high voltage point X2 (see FIG. 4), from shorting out the high voltage Vc. The cathode of diode D1 is connected to the trigger input of shunt switch 6*a* and its anode to the trigger signal and anode of diode 6*aa* whose cathode is connected to the trigger input of SCR switch 5*a*. Diode 6*aa*, placed in series with the trigger of switch 5*a*, is required to prevent current from flowing from the cathode of switch 5*a* into the trigger of shunt switch 6*a*.

In FIG 8*b*, which is a partial circuit drawing of FIG. 4 with like numerals representing like parts with respect to FIG. 4, is shown the implementation of the dual SCR switch of FIG. 8*a*.

FIGS. 9*a* and 9*b* are approximately to-scale side and front views of a preferred smaller core than the ETD-54 core, using the bobbin shown in FIG. 9*c* (shown partial side view of approximately twice scale). The entire coil is shown (not to scale) in FIG. 9*d*. Like numerals represent like parts with respect to the earlier figures. Preferred dimensions are given in the table of FIG. 9*e* for a more compact core with shorter length "l" than the equivalent ETD type core.

The coil of FIG. 9*d* is the preferable stress balanced coil with the bobbin wound according to the procedure already disclosed. Preferably the secondary winding has a total turns Ns of approximately 700 for the preferred primary turns Np equal to 12, giving a slightly smaller yet high primary leakage inductance Lpe of approximately 10 uH for the 12 primary turns Np due to the shorter equivalent length "l", and due to the already disclosed small separation of approximately 0.03" between the primary winding and the first compartment of the secondary winding with the preferred higher number of turns N1, such as 180, in the first secondary winding compartment adjacent to the primary winding (and 160, 140, 120, 100 in the remaining four compartments).

For this coil, the preferred capacitance value C1 of the capacitor 4*a* associated with the initial discharge through the coil can be extrapolated from the values for the ETD-54 core based coil of FIG. 4. For the same magnetic stress, i.e. 4.2 kGauss, the capacitance C1 is given by:

C1=(Lpe/Lpe)*[(Np*Ap/Np'*Ap')**2]*C1' where the primed parameters are those corresponding to the ETD-54 core based coil, and it is assumed that the capacitor voltages Vc and the ratio of the leakage inductances Lpe/Le1 are the same for the two cases.

C1=(10 uH/10 uH)*[(12*2.4/11*2.8)**2]*2.3 uF

C1=2.0 uF

Assuming a stress balance condition:

Le1/Lpe=0.6, we obtain

Le1=6 uH which defines the parameters of the ignition coil circuit, i.e. the (auxiliary) high frequency discharge circuit comprised of the coil primary winding 1*a* (with leakage inductance Lpe), the inductor 15 (Le1), and capacitor 4*a* (C1).

It is to be recalled that if other than conventional ferrite material is used for the coil cores with higher saturation flux density, then the core dimensions can be reduced accordingly as long as the material exhibits a high permeability (A1 of greater than 10,000 uH per 100 turns) at the high open circuit frequency, where Alj for a "jth" inductor with Nj turns relates to the inductance Lj as:

$$Lj=Alj*(Nj**2)$$

In the above case, the open circuit frequency f4 is approximately 120 kHz and the coil primary inductance Lp, at this frequency, must be several hundred microhenries to not compromise the open circuit voltage. This requires a high frequency, high permeability core material, typically not available in other than ferrite, or in too expensive or difficult to fabricate materials such as Metglas.

On the other hand resonating inductors 3 and 15 are of lower inductance, i.e. of lower effective permeability, which are achieved with large air gaps or open core structures as already discussed. A preferred approach is to use iron powder cores (closed cores without air gaps) which have an inherently low effective permeability resulting from their distributed air gap. E-cores with "A1" values of 500 to 1500 uH per 100 turns are particularly suitable.

For the application in which C0 is approximately 3 uF and C1=2.0 uF, suitable cores are standard ones with square center legs of ⅝"×⅝" (2.5 square cm area) and ½"×½" (1.6 square cm area) for inductors 3 and 15 respectively, for an overall dimension for the inductor/capacitor sub-assembly of 6" by 1½" (assuming capacitors C0 and C1 take up less area than 2.5"×1.5"), giving typical overall dimensions for the entire coil assembly of 6" by 3½" inches. If a larger capacitor C0 is desired, then a larger core for inductor 3 would be used, e.g. with ¾"×¾" center leg (3.6 square cms area), or larger.

For lower frequency inductor 3 of inductance Le0, the peak magnetic flux density, designated as B100, is given by:

$$B100=Vc*\mathrm{SQRT}[C0*A1]/A0$$

where A0 is the core area, and A1 is in uH/100 turns. Assuming a core with area A0=2.5 square cms, A1=1200, Vc=350 volts, and C0=3 uF, then:

$$B100=350*\mathrm{SQRT}[3*1.2*10**(-3)]/2.5$$

$$B100=8.4\ \mathrm{kGauss}$$

which is a good design value below saturation for powdered iron core material and of acceptable core loss at this peak value of flux density, i.e. the peak flux density preferably should be less than 10 kGauss. For sixteen turns of wire, i.e. N0=16, the inductance Le0 is:

$$Le0=(1200)*(16/100)**2$$

$$Le0=30\ \mathrm{uH}$$

and, as already pointed out, the number of turns can be varied to change the inductance, and hence the amplitude and duration of the lower frequency spark component determined by C0 and Le0.

For inductor 15 of inductance Le1, the peak magnetic flux density which now must include the leakage inductance Lpe as part of the circuit, designated as B101, is given for a core of area A2:

$$B101=Vc*\mathrm{SQRT}[(C1*A1)/(Lpe/Le1+1)]/A2$$

Assuming core area A2=1.6 sq. cms, A1=1000, Vc=350 volts, C1=2.0 uF, Lpe=10 uH, and Le1=6 uH according to the stress balance condition:

$$B101=350*\mathrm{SQRT}[((2.0*10**(-3))/((10/6)+1)]/1.6$$

$$B101=6\ \mathrm{kGauss}$$

which is well below the peak value of 10 kgauss, which would permit an even smaller core to be used if required. The value of Le1 of 6 uH is obtained by winding 8 turns of wire (N1=8) on the core.

It should be noted that while the preferred embodiment of the present invention, which comprises the dual discharge circuit with dual SCR switches Si/SDi (with diodes at their triggers) and stress-balanced coils employed in a hybrid capacitive-inductive ignition format, differs substantially from other circuit formats, it differs in even more fundamental ways in that a principle feature of the present invention is to produce a single spark pulse of the high power arc discharge of spark power greater that 50 watts and peak spark current of the arc discharge type greater than or equal to 1 amp using the high efficiency voltage doubling features disclosed in my prior patents cited (typically with DF equal to about 0.1, i.e. 0.05 to 0.2, and less than 0.4 under most conditions envisioned). More specifically, high efficiency SCRs, such as the Motorola MCR-265, are preferably used for the shunt switches SDi which carry most of the primary current and have a forward drop of less than 2 volts for peak current under 200 amps, and the resistance of the primary circuit, including the resistance of all the inductors and of the coil, both the primary winding of the coil and its secondary winding resistance transformed to the primary side, are designed to be less than or equal to 50 milliohms (at a frequency of 1 kHz), a low overall resistance leading to a high circuit efficiency.

On the other hand, other circuits, which use diodes across discharge capacitors to achieve some form of the hybrid feature, are designed specifically for the glow discharge and use multiple pulse spark discharges to deliver energy, which (among other things) are not useful for higher engine flow conditions. Further, circuit elements are used to control the multi firing spark by limiting, and even purposely dissipating, the electrical energy, while in the present case circuit elements are used to minimize circuit losses and maximize efficiency of the very high current arc discharge as disclosed above.

Figure 10:
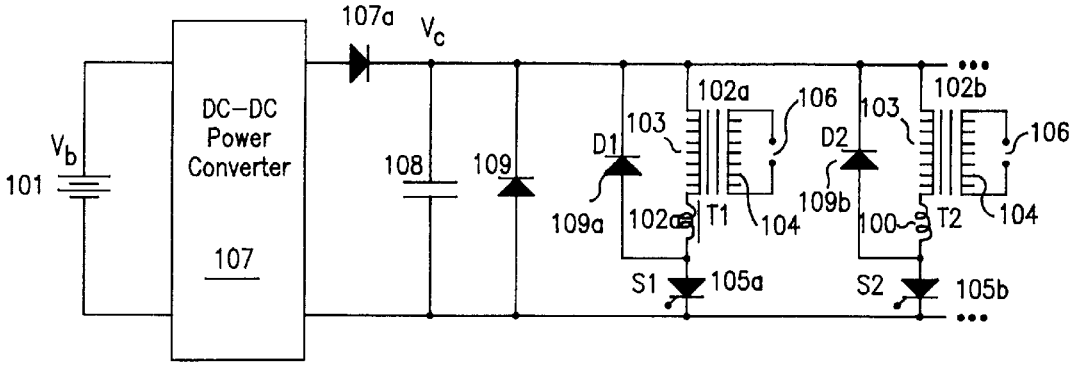
FIG. 10 is a partial block diagram partial circuit diagram of an embodiment of a distributorless version (Type I) of the ICDI system showing two of several coils and associated main SCR switches and shunt diodes with no external inductors in the circuit.

FIG. 10 is a partial block, partial circuit diagram of a distributorless version of the ICDI system, powered by a standard 12 volt car battery 101 (voltage Vb) with two ignition coils 102*a* and 102*b* of several shown stacked in parallel (also designated as T1, T2, or more generally Ti, where "i" designates the "ith" transformer coil). Each coil has a primary winding 103 of turns Np and inductance Lp and coil primary leakage inductance Lpe (shown as an external inductor 100) and secondary winding 104 of inductance Ls with a spark gap 106. The coils 102*a*, 102*b*, each have a switch 105*a*, 105*b* (also designated as S1, S2) in series with their primary windings and shunt diodes 109*a*, 109*b* (also designated D1, D2,) shunting their primary windings respectively. The switches are preferably silicon controlled rectifiers (SCRs). The ignition uses a DC-DC power converter 107 with output diode 107*a* which charges the energy storage discharge capacitor 108 to a voltage Vc above battery voltage Vb, typically between 300 and 500 volts, with capacitor 108 preferably shunted by diode 109.

This embodiment of a distributorless CD circuit is one of several already disclosed. The circuit topology is designated type I. The advantage of this design in which no external inductors are included is simplicity and compact packaging with parts (excluding the coils) of sufficiently low count that they can be easily and practically packaged into one small unit, and the coils can be located near or on top of the spark plugs for the preferred one coil per plug application. In this configuration, as already disclosed, only the first quarter sine wave current flows through the switches 105*a,* 105*b,* with the main, longer duration, decaying spark current flowing through the shunt diodes 109*a,* 109*b* which are preferably high efficiency heat-sunk diodes.

Figure 11:
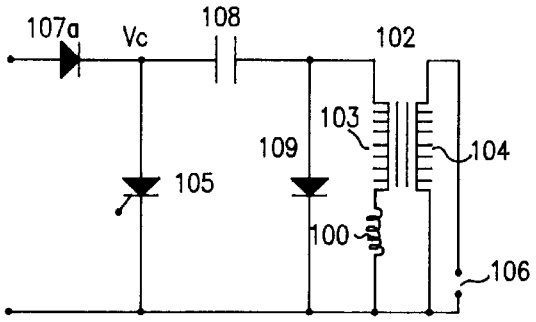
FIG. 11 is a circuit drawing of the discharge circuit of a distributor (single coil) circuit of the Type II topology using an SCR as the main switch.

A partial circuit drawing of an engine distributor one coil version of the ICDI system is shown in FIG. 11. Like numerals refer to like parts with respect to FIG. 10. The single coil is designated as 102 with a single switch 105 (SCR shown although other switches such as Insulated Gate Bipolar Transistors, IGBTs, may be used). This circuit is one of at least two possible circuit topologies for CD ignition, which is designated type II (versus type I of FIG. 10). In this topology, discharge capacitor 108 is not across the power supply as in FIG. 1, but in series with the high side of the power supply and returned to ground (low side of the power supply) through a shunt diode 109 shunting the coil primary winding. This has the advantage that, assuming all but the coil parts are in a box with the power supply (not shown), the wires to the coil are at ground potential even if capacitor 108 is charged. Also, the low side of the primary winding (at ground potential) can be connected to the low side of the secondary circuit, thus requiring only two wires between the box and coil. Like the case of FIG. 10, the initial quarter sine wave current (primary and secondary spark current) flows through switch 105 and the main primary decaying current flows through diode 109, which for distributor ignitions for high performance V-8 engines may be highly stressed and should be one or more paralleled high efficiency heat sunk-diodes. A disadvantage of this design (type II topology) is that the power supply output is shorted during ignition firing.

Figure 12:
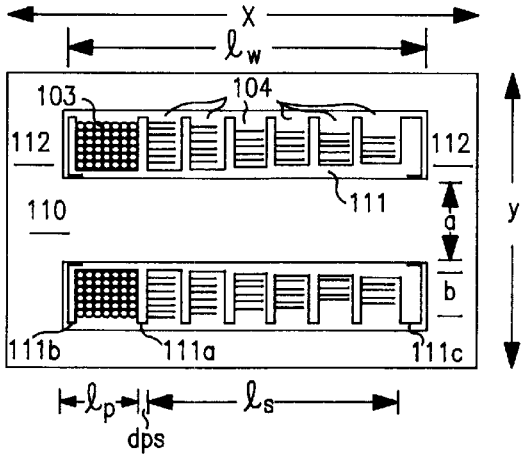
FIG. 12 is a side-view drawing of the preferred coil with side-by-side windings using laminations for the core looking down at the lamination flats and showing the preferred one piece segmented bobbin on which both the primary and secondary turns are wound.

A preferred design coil for the circuits of FIGS. 10 and 11 is shown in FIG. 12 in an approximately to-scale side view drawing based on a laminated SiFe core 110, looking down on the lamination flats. Principal features of this design are the side-by-side windings with the primary winding 103 window length lp taking about ⅕ to ⅓ the core window length "lw", preferably ¼ to ⅓ of lw. The secondary winding 104 (winding window length "ls") is shown as a segmented winding already disclosed (six segments shown) wound on a bobbin 111 with the primary winding 103. An equation describing approximately the leakage inductance of this type of winding structure is given by:

$$Lpe=(a/b+1)\cdot lw'\cdot(Np/10)^2 \text{ uH}$$

$$lw'=lp+ls+3\cdot dps \text{ cms}$$

where "a" is the core center leg width assuming a square core (or average side dimension of a rectangular core), "b" is the available winding height averaged between the primary and secondary windings, with $1<a/b<3$, "dps" is the sideways separation between the two windings, and lw' is the winding length. For a round core, "a" is replaced by SQRT[π/4] times the diameter of the core.

For a preferred design of the coil the separation "dps" between windings (flange 111*a*) is made as thin as practical, e.g. about equal to the thickness of the flanges separating the secondary winding segments or bays. In that preferred case, lw' can be replaced by the winding length lw since the additional factor of 2·dps will be almost made up by the thickness of the end flanges 111*b* and 111*c*.

For optimizing the design of the coil, the equation for the peak core magnetic flux density Bp is required, given by:

$$Bp=[Lpe\cdot Ip]/[Np\cdot A]$$

where A is the core area. For this CD type ignition, the above equation can be approximated, assuming perfect coil coupling for simplicity, as:

$$Bp=\text{SQRT}[(2\cdot Ep/A^2)Lpe/Np^2]$$

where SQRT means "square root", Ep is the energy stored on the discharge capacitor Cp (which is assumed to be fully discharged upon ignition firing). Substituting for the inductance Lpe, one obtains:

$$Bp=\text{SQRT}[(2\cdot Ep/A^2)\cdot(a/b+1)\cdot lw/100]$$

where the optimal value of core magnetic flux density B is preferably taken within 25% of the saturation value, say 1.6 Tesla for SiFe laminated core.

In this application, the stored energy Ep is about 200 mj, where the term "about" means between ½ and 2 times the quantity it references. For the typical preferred stored energy of approximately 200 mj and operating voltage Vc of approximately 360 volts (400+ voltage rating capacitor 8), approximately 3 uF capacitance is preferred, and preferably leakage inductance Lpe of about 200 uH are preferred for a preferred primary turns Np of 40 to approximately 60.

A preferred design of a more compact coil for a distributorless ignition system where each coil is run less hard than a coil for a distributor ignition, is given by the following approximate values of parameters:

a=0.5" (1.25 cms); lw=1.6" (4 cms); b=0.24" (0.6 cms)

Np=40; lw'=lw=4 cms $Lpe=(0.5/0.25+1)\cdot(4.0)\cdot(40/10)^2$ uH=200 uH which is a desired lower range value for Lpe of this embodiment and conforms to the approximately measured values for an assumed square core.

For Cp=3 uF; Vc=360 volts; Ep=200 mj; A=1.5 $cms^2$

Zp=SQRT(Lpe/Cp)=8 ohms

Ip=Vc/Zp=45 amps, assuming perfect coil coupling for simplicity

Bp=(2.00·45)/(40·1.5)=1.5 Tesla which is in the range of optimal coil peak flux density Bp for a distributorless ignition coil which is run less hard than a distributor ignition coil.

Typically, the primary winding has copper magnet wire of 16 to 20 AWG and secondary wire of 32 to 38 AWG depending on the available winding space. For the coil this gives a primary resistance Rp and a transformed secondary resistance $Rs/N^2$ of preferably about 0.1 ohms each, i.e. 0.05 to 0.2 ohms, with the lower range for coils of distributor ignitions that work much harder.

In terms of the preferred range of values of leakage inductance Lpe of 100 to 400 uH, the coil is designed to give a primary leakage resistance Rpe (with the secondary winding shorted) measured at 1 kiloHertz (kHz), of between 100 and 400 mΩ, and more particularly as a ratio of Rpe/Lpe of about 1 mΩ/uH versus 2.5 to 10 for existing state-of-the-art CDI coils. In terms of Qpe, preferred the value is approximately 10, preferably approximately 15 for a lower loss distributor ignition coil that has to fire many spark plugs, and approximately 10 for distributorless one-coil-per-plug ignition, versus less than 5 for current coils.

The secondary or peak spark current Is depends on the primary to secondary turns ratio N, which will range between 40 and 80, and more typically 50 to 70 for the present application with preferred 400 volt rating for capacitor means 108. For a turn ratio N of 60, the maximum peak spark current is:

Is=Ip/N=45/60=750 ma although the value will be lower due to imperfect coil coupling and incomplete discharging of the capacitor if a controllable switch is used for the SCR.

If lower spark current is desired for the same stored energy, then the leakage inductance Lpe can be increased by increasing the primary turns Np, the average lamination width "a" and/or the winding length lw, and increasing the turns ratio. For the same energy, the core area A (proportional to $a^2$) must be also increased to maintain the same Bp. Alternatively, one or more external inductors may be added as has been disclosed.

In this coil design the coil output capacitance Cs is small due to the preferred segmented bobbin 111, the stored energy is high, and the turns ratio N is low so that the voltage doubling factor $DF=2/(1+N^2 \cdot Cs/Cp)$ is high (close to 2), as is preferred. For example, for the following parameters:

Cs=40 picofarads (pF); Cp=3 uF; N=60

$DF=2/[1+(60^2 \cdot 40)/(3 \cdot 10^6)]=2/[1.048]=1.9$

It is also noted that since preferably the SiFe lamination material is grain oriented, that the areas where the magnetic flux is at right angles to the grain orientation (the core end pieces 112) should preferably have a somewhat larger area to achieve optimization, e.g. 30% larger.

Figure 13:
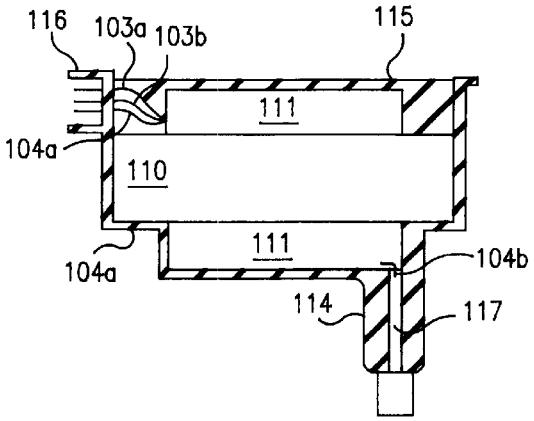
FIGS. 13 and 14 are cutaway side-view edge drawings showing partial details of the coils encapsulated in housings defining a block type coil structure.
Figure 14:
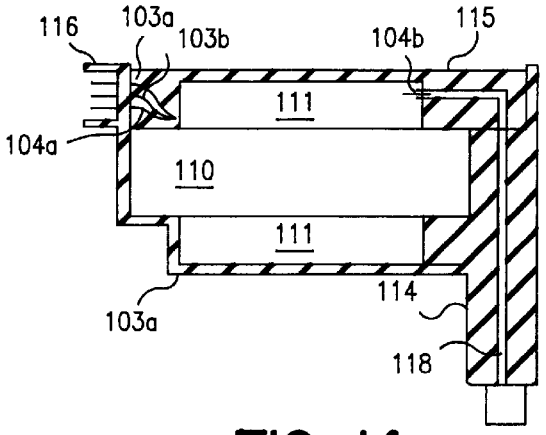

In FIGS. 13 and 14 are shown side views of encapsulated coils in a housing 113, with like numerals representing like parts with respect to FIG. 12. These designs represent "block" type coils with the high voltage tower 114 protruding at right angles to the plane of the laminations 110 at the side opposite to the open end 115 of the housing (where the coil is inserted and the housing filled with encapsulant). The ends 113*a,* 113*b,* of the primary winding and the start lead of the secondary winding 114*a* are taken to a connector 116 at the end of the open side of the housing for ease of connection. In FIG. 13 the high voltage end 104*b* is terminated in a pin 117 which can be inserted in the center of the high voltage tower 114 which gives a more compact design. In FIG. 14 the high voltage tower is located beyond the end of the laminations with a wire 118 brought vertically to the open end 115 where it can be connected to the high voltage lead 104*b*. In this design, mounting holes may also be placed adjacent to the high voltage tower 114. In both designs the housing 113 is preferably tight fitting around the core 110 and bobbin Ill to minimize the encapsulant used.

A distributor version of the coil will preferably be larger to have lower resistances Rp and Rs and lower peak magnetic flux density Bp approximately ½ the saturation value Bsat of 2 Tesla for grain oriented SiFe, or approximately 1 Tesla to reduce the coil heating since the coil has to work harder. However, the design will follow that given, with preferably Np of approximately 55, N of approximately 60, Lpe of approximately 300 uH, and a peak spark current Is of approximately 600 ma for relatively high resistance to flow segmentation and acceptable spark plug erosion (also preferred for distributorless ignition).

For the core of the coil disclosed Si-Fe laminations are preferred because of their high saturation magnetic flux density Bsat and low cost, but any of a number of other core materials are possible, including non-oriented iron based material, nickel alloys, powder iron, metglas, and others.

For the current system disclosed spark energies of 120 mj and higher have been attained (for 200 mj stored energy) versus 20 mj to 30 mj for more conventional CD systems, and overall efficiency of 50% versus 10% to 25% attained (using high efficiency power converters), and peak spark currents in the 500 to 800 ma range attained, the range required for good engine performance.

More generally, the overall results of the improvements described herein include enhanced igniting ability from the much higher delivered energy, reduced plug erosion from the moderate currents of this very high energy ignition, and reduced size and cost relative to other CDI systems for the delivered energy. Moreover, the ICDI system, as disclosed, is ideally suited for more advanced engine technologies, from racing and performance, to advanced high efficiency lean burn engines with high swirl, tumble, and squish which require high current high energy ignition system resistant to spark break-up by the high flow.

With regard to the preference that Lp/Lpe be equal to and greater than 10, and given that Lp is inversely proportional to the magnetic path length lm, then a more compact more square design is preferred with minimum separation "dps". Another preferred design based on a winding window cross-section dimension of 1.5" by 0.45" is given by:

a=0.5" (1.25 cms); lw=lw'=1.5" (3.8 cms); b=0.3"

Np=50; N=Ns/Np=60

$Lpe=(0.5/0.3+1) \cdot 3.8 \cdot (50/10)^2$ uH=250 uH where a capacitance Cp is approximately 3 uF for Vc of approximately 360 volts to give a peak magnetic flux density Bp of 0.8 to 1.6 Tesla depending on the more exact selection of values. This would give an essentially square overall dimension for the top view (FIG. 3) of the laminations, i.e. X by Y of 5 by 5 cm (within ±10%). In the equations it is assumed that values quoted with an equal sign, i.e. N=50 are taken to be within ±10% of the value quoted, i.e. Np is equal to 50±5, where the actual numbers are taken to satisfy the particular application and constraints, such as coil electrical losses and heating of the coil at high engine speeds. The above dimensions are given as a reference point, where the coils may be larger for higher energy and/or lower dissipation, and vice versa, using guidelines disclosed to define the detailed dimensions.

For a winding window length of 1.5" (4 cms), a possible dimension for the bobbin with assumed six bays is bay width of 0.14" (0.36 mm), flange thickness of 0.035" (0.9 mm) for the six inner flanges, and primary winding width lp of 0.3" (0.75 mm).

Figure 15A:
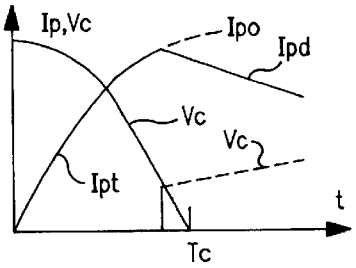
FIGS. 15*a* and 15*b* are voltage and current waveforms associated with the operation and control of the circuit of FIG. 15.
Figure 15B:
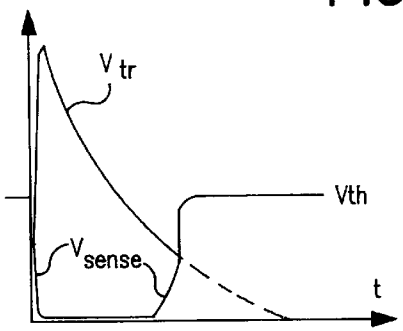
Figure 15:
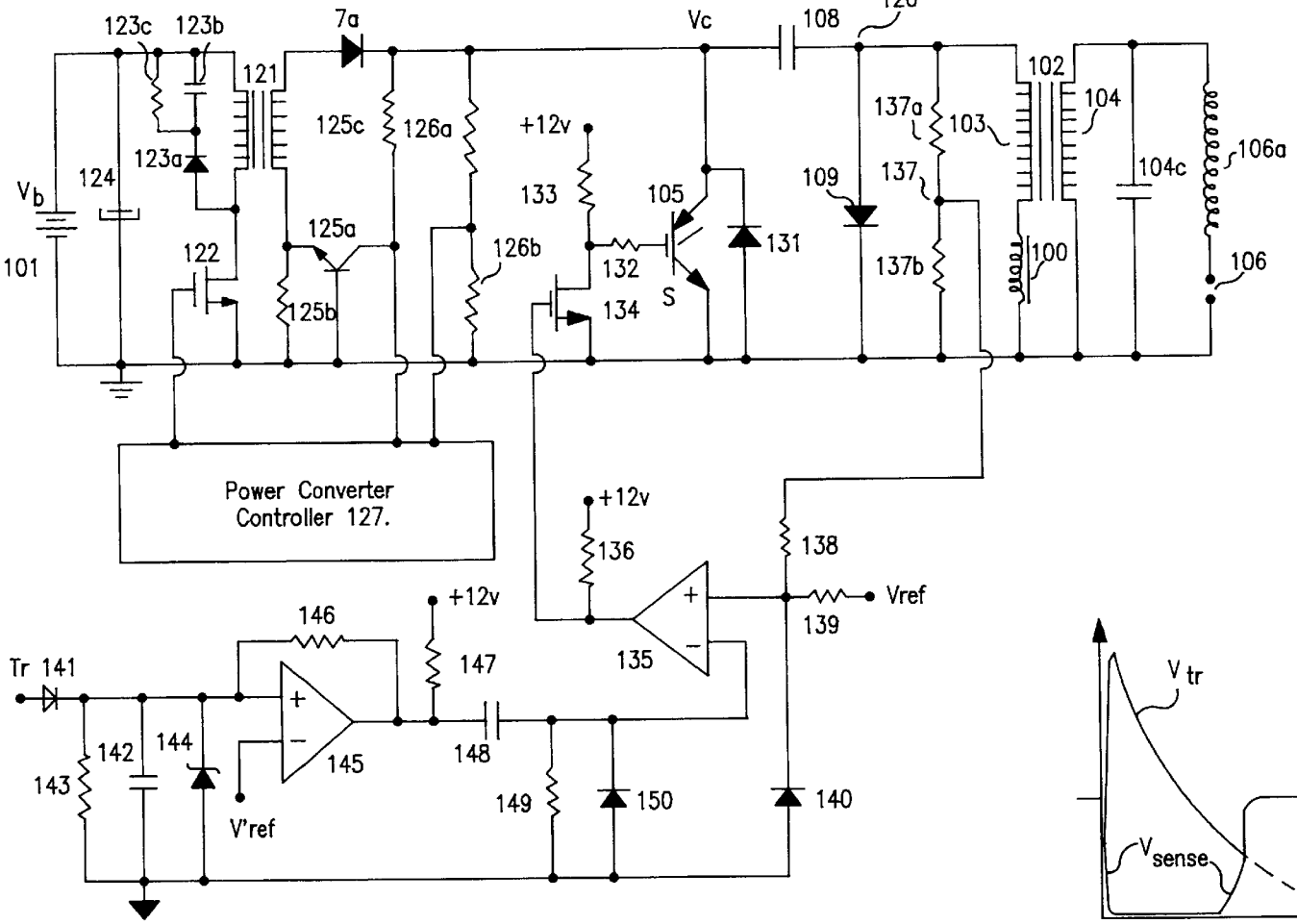
FIG. 15 is a more detailed circuit drawing of a preferred embodiment of a distributor ICDI ignition of Type II topology using an IGBT as the main switch and depicting a preferred simple form of control circuit based on sensing of the voltage discharge waveform.

FIG. 15 is a more detailed circuit drawing of a preferred embodiment of a distributor ICDI ignition of Type II topology using an IGBT as the main switch which can be turned off before the discharge capacitor is fully discharged to speed up the capacitor recharging. IGBT turn-off is controlled by simple form of control circuit based on sensing of the voltage discharge waveform. Like numerals represent like parts with respect to FIGS. 10 to 14.

For the DC-DC converter 107 is shown a flyback type converter disclosed in U.S. Pat. No. 5,558,071 comprised of low leakage transformer 121, N-type FET switch 122 (preferably 60 volts rating), snubber circuit made up of diode 123*a,* capacitor 123*b,* and resistor 123*c,* input filter capacitor 124, current sense means comprised of NPN sense transistor 125*a,* resistor 125*b,* and off-time resistor 125*c* and output voltage regulator resistors 126*a* and 126*b*. Remaining components making up the FET 122 driver and converter controller are shown as block 127.

In place of the SCR 105 of FIG. 11 is shown IGBT 105 (designated also as switch S) with protection diode 131 across it. The drive circuit for the IGBT comprises an optional gate resistor 132 connected to a supply voltage (12 volts regulated voltage shown) through a pull-up resistor 133. To the gate resistor 132 is connected IGBT control switch 134 which normally keeps the IGBT gate low. For the control switch is shown an N-type FET with drain connected to the gate resistor 132 and source to ground and its gate connected to the output of a comparator 135 with pull-up resistor 136 to a supply voltage (12 volts shown). The comparator output is normally high, keeping control switch 134 turned-on and switch S off (gate of IGBT 105 pulled to ground). Normally, inverting input of comparator 135 is low (no trigger signal) and the non-inverting input is high.

Turn-on of the IGBT is achieved by a trigger signal raising comparator 135 inverting input above a threshold voltage Vth. Turn-off uses a voltage sensing circuit instead of current sensing because when approaching the turn-off voltage of say 0.2·Vc to 0.4·Vc, the primary current Ipt (see FIG. 15*a*) through transistor switch S is close to its maximum sine wave value which is slowly varying with time, versus the voltage at node 120 (normally low side of discharge capacitor 108) which changes rapidly as it approaches zero volts (and the peak current Ipo is approached). Therefore, voltage instead of the normal current sensing is used.

The sense circuit is comprised of a voltage divider made up of resistors 137*a* and 137*b* connected between node 120 and ground (of values, for example, 47K and 3.3K respectively). To the intersection of the divider (node 137) is connected resistor 138 (e.g. 15K) which is connected to the non-inverting input of the control comparator 135, to which is also connected resistor 139, e.g. 10K, taken to a reference voltage Vref, e.g. 5 volts, and a Schottky diode 140 taken to ground (anode to ground). The effect of this circuit is to apply a threshold voltage Vth to the non-inverting input at all times except during ignition firing (Vth somewhat less than Vref). Upon ignition firing, node point 120 (voltage Vnode) goes negative to voltage approximately −Vc and decays as a cosine with quarter period Tc equal to ½π·SQRT [Lpe·Cp], typically 30 to 60 usecs. At the non-inverting input of comparator 135, designated as the sense node of voltage Vsense, the two voltages Vref and Vnode are summed, weighted by the resistors of the sense circuit, to produce the voltage Vsense shown in FIG. 15*b*. Voltage Vsense is prevented from going negative due to the clipping Schottky diode 140. Upon ignition triggering, voltage Vsense drops from Vth to ground, remains at ground for most of the quarter period Tc, and then starts to rise towards Vth while the trigger voltage Vtr decays to equal Vsense to correspond to the desired voltage Vcr remaining on the discharge capacitor. When Vsense equals Vtr, the comparator output flips and returns to the high condition, turning on control switch 134 and turning off IGBT 105. The current Ipt through the IGBT switch diverts to the shunt diode 109 as a decaying current Ipd with corresponding secondary spark current Is.

For the trigger circuit any of a number are possible. In this drawing is shown an input trigger conditioner comprised of an in-series isolation diode 141, charging capacitor 142 with shunt resistor 143 and clipping Zener 144 connected between the non-inverting input of a comparator 145 and ground and a hysteresis resistor 146. Inverting input is held at some reference voltage $V'_{ref}$. Output of the trigger comparator 145 is tied through a resistor 147 (value R147) to a reference voltage greater than Vref, 12 volts shown. A timing waveform Vtr is produced by a differentiating trigger capacitor 148 (value C148) in series with the comparator output and terminated with a resistor 149 (value R149) to ground. Across the resistor 149 is a Schottky diode 150. Normally the output of trigger comparator 145 is low with trigger capacitor 148 discharged. When a trigger is received, the output goes high and the inverting input of the control comparator 135 goes high to Vtr and then decays as capacitor 148 is charged with a time constant approximately equal to (R147+R149)·C148, which typically will range between 10 and 20 microseconds depending on the period Tc and reference voltages Vref and Vc (divided down by the divider 137*a*/137*b*).

For spark plug wire low resistance (below 50 ohms), high inductance spark plug wire 106*a* is preferred, e.g. with well over 200 uH inductance to reduce the peak current from the coil secondary output capacitor 104*c* without limiting the overall spark energy.

Figure 16:
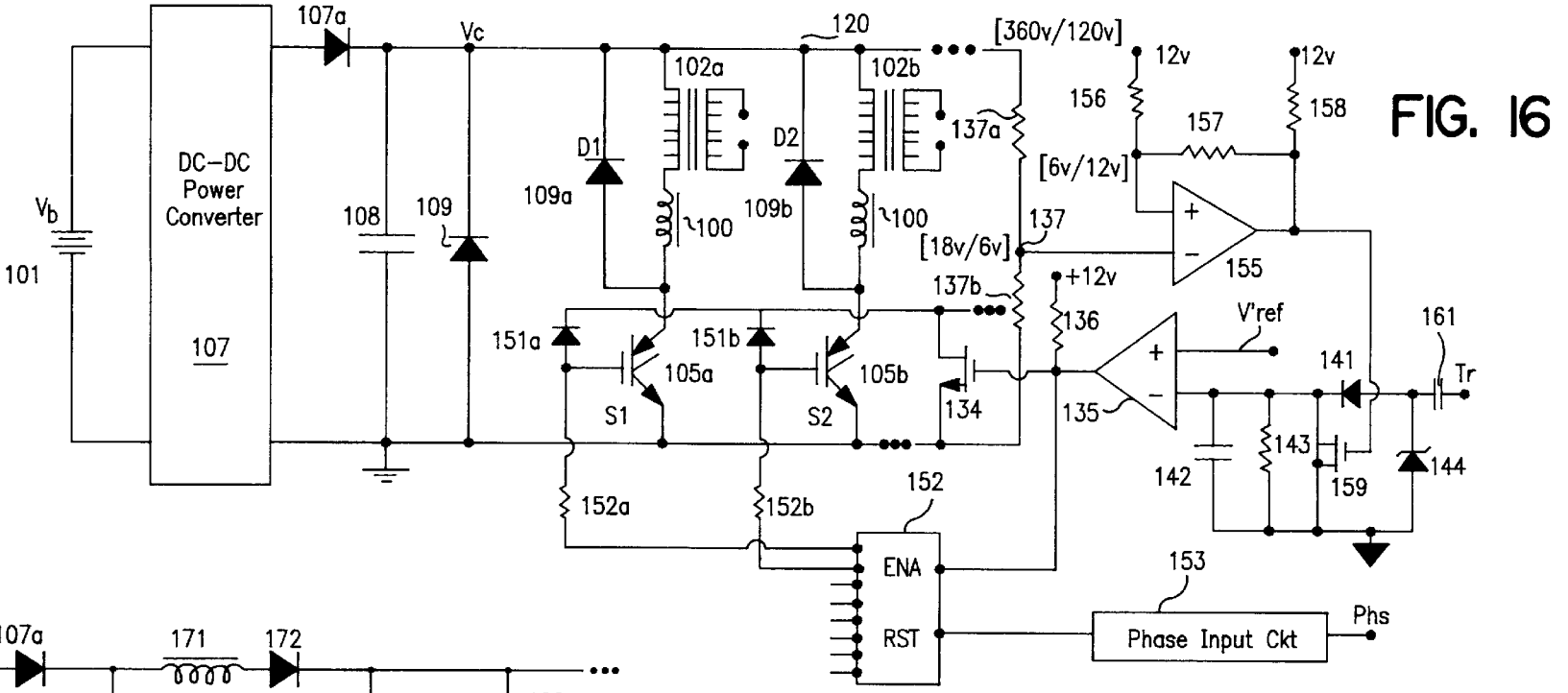
FIG. 16 is a circuit drawing of a preferred embodiment of a distributorless ICDI ignition of Type I topology showing two of several possible coils using IGBTs as the main switch elements and depicting a preferred simple form of control circuit based on sensing of the voltage discharge waveform.

FIG. 16 is a circuit drawing of a preferred embodiment of a distributorless ICDI ignition of Type I topology showing two of several possible coils using IGBTs as the main switch elements with shunt diodes and depicting preferred simple form of control circuitry based on sensing of the voltage discharge waveform, as with FIG. 15 except that the sensed voltage is positive in this case. Like numerals represent like parts with respect to FIGS. 10 to 15.

Turn-on and turn-off of the main IGBT switches 105*a* and 105*b* use the same circuit of a control comparator 135 and control switch 134 except that isolation diodes 151*a*, 151*b*, . . . , are now required for connecting the gates of the IGBT switches 105*a*, 105*b*, ..., respectively to the drain of control N-type FET switch 134. In addition, an octal counter 152 is shown for energizing each IGBT switch in turn through resistors 152*a*, 152*b*, . . . , with its enable (ENA) input connected to the output of control comparator 135 for sequencing the counter with each trigger input. A phase input circuit (shown as block 153) is used for resetting the counter as is known to those versed in the art.

As in FIG. 15 a divider 137*a*/137*b* is used to reduce the voltage Vc except that a different circuit is used to achieve turn-off at some voltage Vcr. In this case, node 137 is directly connected to the inverting input of a pre-control comparator 155 whose non-inverting input is taken to a regulated voltage (12 volts shown) through a resistor 156 (value R156) with a hysteresis resistor 157 (value R157) of comparable magnitude to produce substantial hysteresis. Output of comparator 155 is taken to the same reference voltage (12 volts) through a resistor 158.

Control comparator 135 has its non-inverting input tied to a fixed reference voltage $V'_{ref}$, e.g. 2.5 volts, and its inverting input has a pre-control switch 159 connected between it and ground (N-type FET shown) with its gate connected to the output of the pre-control comparator 155. Without an ignition trigger, the inverting input of control comparator 135 is low irrespective of the output of comparator 155, keeping switch 134 turned-on and the IGBTs switches S1, S2, . . . , off. When an ignition trigger is received, control comparator 135 switches states enabling the IGBTs and one IGBT switch is turned on by the counter 152.

The IGBT remains turned-on until the voltage at the inverting input of the pre-control comparator 155 equals the reference non-inverting input voltage. For example, assuming Vc is 360 volts and the desired turn-off voltage Vcr is 120 volts, shown in the figure as the voltage pairs [360v/

120v] at node 120 with corresponding voltages at node 137 of [18v/6v], and assuming R156 equal R157, then the non-inverting input is 6 volts when Vc is above 120 volts. Comparator 155 flips when Vc drops to 120 volts, the non-inverting input flipping from 6 volts to 12 volts [6v/12v] as shown due to hysteresis, turning off (disabling) the IGBTs and keeping them off while Vc is recharging up to approximately twice Vcr, i.e. 240 volts shown in the example, by which time the input trigger has decayed so that control comparator stays in the high output state as required until the next input trigger is received. Sample values for the divider resistors 137*a,* 137*b* are 470K, 22K, and for the resistors R156 and R157 the value 47K.

For the input trigger circuit several possible options exist. In this case is shown differentiating input with in-series capacitor 161 and reference Zener 144, isolation diode 141, and capacitor/resistor pair 142/143 shunting inverting input of control comparator 135 to ground. This produces a fast rising pulse with decaying tail which is long enough to keep switch 134 on for the required 30 to 50 microseconds and short enough (for long input trigger pulses) to insure comparator 135 inverting input is low relative to $V'_{ref}$ prior to the recharge capacitor reaching the value of two times Vcr, or 240 volts in this example.

In this application, the power converter 107 is kept on during the ignition firing. Shunt diodes D1, D2, . . . , are preferably high efficiency diodes with heat sinks as they carry most of the primary current. The IGBT switches are preferably 400 to 600 volt switches that can provide the high peak currents of 40 to 50 amps with low collector to emitter drop (Vce). The turn-off voltage level Vcr will depend on application, and can range from zero volts to 100 volts or higher, the higher the voltage the quicker the recharge of the discharge capacitor 108, the lower the peak primary and secondary spark currents, and the higher the IGBT switching losses. Other switches than IGBTs may be used although currently they are the preferred for the present application where switch turn-off is required (versus SCRs).

Figure 17A:
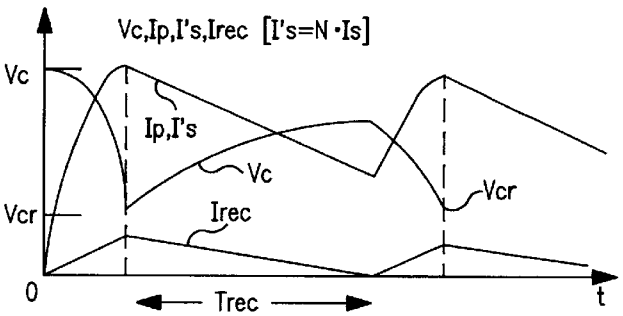
FIG. 17*a* is voltage and current waveforms associated with the operation of the circuit of FIG. 17.
Figure 17:
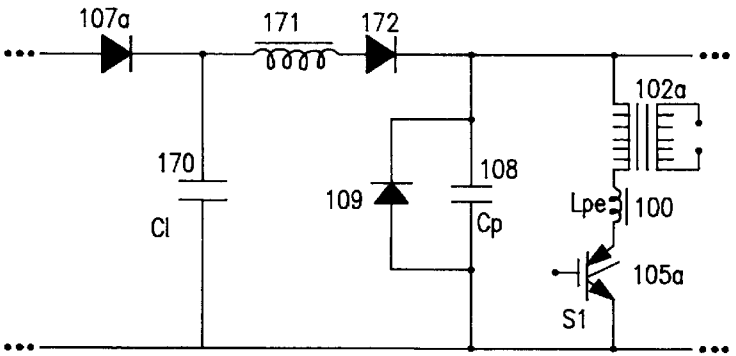
FIG. 17 is a partial circuit drawing of a recharge circuit usable with either topology of discharge circuit (Type I shown) for rapid recharging of the discharge capacitor if such a feature is required.

FIG. 17 is a partial circuit drawing of a recharge circuit usable with either topology (Type I or II) of discharge circuit, with Type I shown, for rapid recharging of the discharge capacitor if such a feature is required. Like numerals represent like parts with respect to FIGS. 10 to 16. Only part of the circuit is shown, including a recharge capacitor 170, recharge inductor 171, and isolation diode 172. Such a recharge circuit is known to those versed in the art and disclosed in U.S. Pat. No. 5,315,982.

In operation, with reference to FIG. 17*a* which shows the voltage and current waveforms associated with the operation of the circuit of FIG. 17, current through inductor 171, Irec, builds up during discharge of capacitor 108 as shown and discharges to recharge capacitor 108 during recharge time Trec. In this way, the discharge capacitor can be recharged to a voltage approximately equal to Vc or less in a short time, e.g. 1/10th the normal recharge time using say a 100 watt power converter. The number of recharges and recharge levels depend on the capacitance of recharge capacitor 170 (Ce), the power supply, the duty cycle, and inductor 171 (Le) as is known to those versed in the art. For example, assuming Ce is much greater than Cp and assuming it is desired to recharge Cp to 0.7·Vc, then Le should be approximately equal to 5 times Lpe. The recharge time Trec will be much shorter than the spark discharge time, e.g. approximately 2 times Tc, so that the IGBT can be sequentially re-triggered to produce a continuous saw-tooth spark current which can be important during cold start where a long duration intense spark may be required, especially for igniting low volatility fuels which may become more important with time.

In cases where a higher spark flow resistance is required, e.g. engines with high flow velocity at the spark plug electrode site, then a spark current with a higher peak current Is may be preferred, e.g. 500 to 800 ma, or even higher in the 1 to 3 amp range as disclosed with reference to FIGS. 1 to 9*d.* In lower flow cases a lower range may be preferred, e.g. 300 to 500 ma. Also, for longer life of the spark plug with good flow resistance, i.e. still three to five times higher than the conventional 50 to 100 ma glow discharge spark, the lower range of 300 to 500 ma peak spark current Is may be preferred, recognizing that the flow resistant arc discharge typically begins at 200 ma spark current.

The lower spark currents entail higher leakage inductance Lpe in the range of 300 uH to 600 uH which are achievable typically with higher number of primary turns Np of 50 to 70. Therefore, a more generic definition of the preferred primary leakage inductance Lpe is for it to be about 300 uH, i.e. between 150 to 600 uH, and the number of primary turns Np to be between 35 and 70 turns. Preferably, Lpe is approximately 300 uH and Np approximately 55. Within these constraints, the relationship between the primary resistance with shorted secondary, Rpe, and the leakage inductance Lpe can be expressed as a quality factor Qpe, where Qpe=W·Lpe/Rpe, where W is the angular frequency. Qpe preferably is greater than 5 at 1 kHz, and preferably approximately 10.

Traditionally, laminations are butt-welded. In this case, interleaving is preferred since it provides a higher inductance (higher ratio of Lp/Lpe) and eliminates the problems of welding or clamping in the mold for encapsulation. Heating and expansion of the coil will also have minimum effect on Lp and on the coil coupling coefficient k between the primary and secondary windings.

Interleaving is also preferred with designs that cannot adhere to the preferred approximately square shape (highest Lp/Lpe). In particular, it is the preference for pencil coil designs which typically have a length to diameter ratio of between 1.5 and 3, and thus a low ratio of Lp/Lpe. A preferred design for a pencil coil using E-type laminations is to have a rectangular instead of standard square center leg cross-section (preferably ratio of 1.5 to 1 of the sides). Also, the end sections (112, FIG. 12) preferably are larger than required for proportional area, e.g. 1.5 to 3 times the cross-sectional area of the center leg. Thinner wire will also be required than disclosed for small diameter (1 inch) pencil coils, e.g. 19 to 22 AWG primary and 38 to 42 AWG secondary wire. For a 1 inch diameter coil, a preferred coil length can be approximately 2 inches, and the center core dimensions can be 0.25" by 0.4" with winding window of 0.25" by 1.5", for a compact design that can be mounted directly over the plug.

Of the various embodiments of the Hybrid (Capacitive-Inductive) Ignition or ICDI system as it has been alternatively referred to, the preferred embodiment for the general application of lean burn and high EGR engines with moderately high flows, i.e. flow velocities ranging between 2 meters/sec (m/sec) and 20 m/sec, and where spark plug erosion is a concern (versus racing applications), is an embodiment of a circuit without external inductors and coils with SiFe laminations (typically standard 14 mil thick laminations) and side-by-side windings to give a leakage inductance Lpe of approximately 300 uH and primary inductance Lp of approximately 6,000 uH. These values are attainable with interleaving of the laminations (measured at 1 kHz, the reference frequency for SiFe cores), with approximately 55 turns Np of primary wire of 16 to 19 AWG wire, depending on desired size of coil, and turns ratio N of approximately 60, wound in a segmented bobbin of the types disclosed. Preferably 400 volt capacitors are used of typically approximately 3 uF capacitance, depending on the requirements for spark energy of the engine. The quality factor Qpe will be about equal to 10. The primary turns winding window length lp will typically be ¼ to ⅓ the total winding length lw and have a height or winding depth approximately equal to its winding length, i.e. approximately square (except for pencil coils). The overall shape and dimensions will vary depending on application, with smaller structures for distributorless ignition.

Since certain changes may be made in the above circuits and coil design without departing from the scope of the invention herein disclosed, it is intended that all matter contained in the above description, or shown in the accompanying drawings, shall be interpreted in an illustrative and not limiting sense.

What is claimed is:

1. An ignition system for internal combustion engines comprising means defining an ignition circuit including at least one energy storage and discharge capacitor C, one or more ignition coils Ti of primary turns Np, secondary turns Ns, and turns ratio N=Ns/Np, where i=1, 2, 3, . . . , and each coil Ti having a coil primary current switch means Si in series with a primary winding of the coil Ti and with said capacitor means comprising a primary ignition discharge circuit which further includes a primary circuit inductance means comprised of a coil's primary leakage inductance Lpe and separate optional resonating inductance means Lej with inductance including zero inductance which with leakage inductance Lpe comprises the total primary circuit inductance Le, the system powered by an electrical power source for supplying power to the ignition system for charging said capacitor means C, and the ignition system operated and fired by an ignition firing means controlled by an ignition controller means to produce ignition sparks by discharging said capacitor means through actuation of said primary current switch means Si, the system constructed and arranged to produce, upon ignition firing through actuation of each said primary current switch means Si, an initial capacitive ignition spark discharge of a first quarter period oscillation defined by resonance oscillation of at least a porion of said capacitor means resonating with at least a portion of said total primary circuit inductance Le, followed by the inductive, essentially linear, decaying spark discharge of a longer period Tc whose peak amplitude corresponds to the peak amplitude of said first quarter period oscillation comprising an arc type spark discharge with an arc current greater than 0.2 amps and voltage doubling factor DF less than 0.4 where $DF=N^2*Cs/C$, and Cs is the total coil output capacitance.

2. An ignition system as defined in claim 1 wherein said inductive decaying spark discharge is produced, in part, by placing one or more first high current diode means D0 across said capacitor means.

3. An ignition system as defined in claim 1 wherein there is included in the ignition circuit a high current high efficiency shunt switch/diode means SDi comprising unidirectional current carrying means of the passive diode type or active controllable switch type in a circuit that includes at least shunting of the primary windings of each of said coils Ti.

4. An ignition system as defined in claim 1 wherein said electrical power source is an alternative integrated boost converter fed by a battery and wherein said converter has a switch SEI connected between said battery and one end of an energy inductor Lb of the converter whose other end is connected to the battery ground, and wherein said capacitor means is connected with its one side at the intersection of said switch SEI and inductor Lb and its other side to the cathode of a charging diode whose anode is grounded, wherein said switch SEI, inductor Lb, capacitor means and charging diode comprises said power converter and load and said inductor Lb also comprises part or all of the ignition circuit resonating inductor Le.

5. An ignition as defined in claim 4 wherein said switch means Si are IGBTs.

6. An ignition system as defined in claim 1 wherein said power converter is a flyback converter with transformer including a primary and secondary winding wound concentrically on a magnetic core to provide a low leakage inductance and a switch means SE for turning on and off current in the primary winding, and wherein said flyback converter is designed to operate with a DC current level which is set and controlled by a sensor resistor of about ½ ohm and an NPN control sensor transistor placed in the secondary winding side of said transformer, said sensor transistor being actuated when its base-emitter voltage is forward biased at approximately 0.62 volts due to excessively high current flow in said transformer secondary winding.

7. An ignition system as defined in claim 6 wherein said power converter DC primary current level is about 8 amps, said change in current level is about 8 amps, and said frequency at which the oscillating part of the current ramps up and down from about 8 to about 16 amps is between 40 kHz and 120 kHz.

8. An ignition system as defined in claim 1 further comprising spark plug output devices with inner central high voltage electrode and outer ground circular electrode forming spark discharge at the electrodes ends of extended essentially circular gap between the inner high voltage electrode and outer ground electrode wherein the spark makes an angle theta of 15 to 75 degrees defined by its length relative to a vertical axis defined by the axial dimension of the spark plug and wherein the spark gap is twenty percent or more smaller than the gap between the end of the insulator along the center conductor and the inner wall of the spark plug shell.

9. An ignition system as defined in claim 8 wherein said extended gap is formed by radially and axially outward extensions of a high voltage center conductor forming a spark gap backwards to the spark plug shell edge.

10. An ignition system as defined in claim 9 wherein plug insulator section insulating central high voltage electrode from spark plug shell is recessed to keep the insulator surfaces at a maximum distance from the spark to minimize spark fouling of the insulator surfaces.

11. An ignition system as defined in claim 9 wherein metallic surfaces defining the spark plug interior combustion volume are coated with combustion enhancing catalyst material.

12. An ignition system as defined in claim 8 wherein said extended gap is formed by axially outward and radially inward extensions of outer spark plug shell forming a spark gap inwards to the spark plug center conductor end.

13. An ignition system as defined in claim 12 wherein said axially outward electrode extensions form an essentially circular spark firing end electrode section with side openings to permit flow of mixture through said extensions.

14. An ignition system as defined in claim 3 wherein said switches Si are IGBT switches.

15. An ignition system as defined in claim 3 wherein said switches Si are SCR's with their cathodes connected to ground and their anodes connected to one end of the primary windings of said coils Ti as well as to the anodes of switch/diode means SDi whose cathodes are all interconnected to the high voltage end of the resonating inductor means so that the closed circuit discharge paths of each coil Ti include an SCR Si in one path and a switch/diode SDi in another path.

16. An ignition system as defined in claim 3 for a multi-cylinder engine with n cylinders and n coils Ti through Tn defining a distributorless ignition wherein there is included one capacitor Cii per coil Ti, one diode Di across each primary winding of each coil Ti, and an isolation diode Dii per coil discharge circuit, and wherein said coil has an E-type core with side by side winding to provide the entire inductance for the discharge circuit comprised of the coil primary winding, said switch Si, the capacitor Cii, and diode Di as the second discharge path.

17. An ignition system as defined in claim 3 wherein E-cores with side-by-side windings are used for the cores of coils Ti.

18. An ignition system as defined in claim 17 wherein said cores are laminations which are interleaved.

19. An ignition system as defined in claim 3 for a multi-cylinder engine with n cylinders and n coils T1 to Tn defining a distributorless ignition including at least one resonating inductor of inductance Lej which forms a series discharge path including said capacitor means with the primary winding of each of said coils T1 through Tn.

20. An ignition system as defined in claim 19 wherein capacitance of said capacitor means is between 1 uF and 10 uF for 200 to 800 volt rating capacitors.

21. An ignition system as defined in claim 19 defining dual discharge circuit wherein said capacitor means includes two sets of capacitors, low frequency discharge capacitor of capacitance C and high frequency discharge capacitor C1, and wherein said separate resonating inductor means includes lower frequency inductor of inductance Le0 associated with capacitor C and a high frequency inductor of inductance Le1, which may be of zero inductance, associated with capacitance C1, and wherein resulting lower and high frequency circuits are separated by diode means, the system constructed and arranged such that upon ignition firing due to actuation of a switch means Si there is initiated a high frequency f3 discharge through resonance oscillation of capacitor C1 and inductance Le1+Lpe followed by a lower frequency f10 discharge through resonance oscillation of capacitor C and at least inductance Le0.

22. An ignition system as defined in claim 21 wherein switches Si and SDi are SCRs with the cathodes of isolating and voltage protection diodes connected to their trigger gates and anodes connected to trigger means and said shunt switch means SDi are placed across, i.e. shunting, the entire primary circuit inductances.

23. An ignition system as defined in claim 22 wherein said switches Si and SDi are integrated into a single component designated as a dual switch Si/SDi.

24. An ignition system defined in claim 21 wherein capacitor C1 is approximately 400 volt rating capacitor of capacitance 1 uF to 4 uF and wherein said capacitor C is of value 2 uF to 8 uF and said inductor Le0 is of value between 20 uH and 10 mH.

25. An ignition system as defined in claim 17 wherein capacitances C and C1 are approximately 3.6 and 2.4 uF respectively, and inductance Le0 is within ½ and 2 times the total high frequency inductance Le1+Lpe.

26. An ignition system as defined in claim 3 wherein said ignition circuit is a distributor type ignition circuit with a single coil T of coils Ti and switch S of Si and wherein said leakage inductance Lpe is between 10 uH and 600 uH.

27. An ignition system as defined in claim 26 wherein the said capacitance means comprises 400 volt rating capacitors with capacitance of 2 uF to 10 uF or other voltage rating capacitor means with equivalent stored electrical energy, and wherein said switch S has its cathode-emitter connected to ground and its anode-collector connected to one end of the coil primary winding and to the anode of said second switch/diode means SDi which is a diode with cathode connected to a point that includes, i.e. shunts, the entire circuit inductance Le.

28. An ignition system as defined in claim 27 wherein said coil T comprises a coil with side-by-side windings to provide the high leakage inductance Lpe relative to that provided by concentric windings and wherein said primary winding comprises 10 to 70 turns of wire and the coil turns ratio N is between 40 and 80 for 400 volt rating capacitor means and adjusted accordingly for different rating capacitors. i.e. reduced for higher voltage rating capacitors, and vice versa.

29. An ignition system as defined in claim 28 and further comprising, in series with said primary winding, a resonating inductor of inductance Lej.

30. An ignition system as defined in claim 28 wherein said coil comprises an E-core with a primary core winding section on which the primary turns are wound and a secondary core winding section on which the secondary turns are wound.

31. An ignition system as defined in claim 30 wherein said core is of ferrite material and wherein the core area Ap on which the primary winding is wound is about one square inch and the core area As on which the secondary is wound is less than or equal to the area Ap and wherein the primary has a winding channel of width W1 of approximately ⅜" wide and the secondary has a winding channel of width W2 of at least ½".

32. An ignition system as defined in claim 30 wherein said core is made of thin stacked laminations.

33. An ignition system as defined in claim 32 wherein said laminations are interleaved to provide higher primary inductance Lp without the need for welding or strapping of the lamination parts.

34. An ignition system as defined in claim 30 wherein said secondary winding is wound in a multi-compartment winding with small separation between the primary winding and the adjacent first compartment of the secondary winding and wherein said secondary winding wound in said compartments is of unequal number of turns per compartment with higher number of turns in the first compartment adjacent said primary winding and lesser number of turns in the last compartment furthest away from said primary winding.

35. An ignition system as defined in claim 34 wherein the coil Ti output capacitance Cs is less than 40 pF.

36. A high energy hybrid capacitive/inductive ignition system with one or more coils Ti with E-cores with side-by-side primary and secondary windings with primary turns between 30 and 70 turns and primary leakage inductance Lpe between 100 uH and 600 uH and with energy storage capacitor means for storing and discharging ignition energy, each coil Ti using unidirectional switches Si and high efficiency shunt diode means SDi shunting the primary winding of its respective coil Ti, the ignition system producing an initial quarter cycle capacitive spark with a peak current in the arc discharge of at least 200 ma followed by a longer duration decaying inductive unidirectional spark discharge flowing through shunt switch means SDi, the system powered and controlled by a power converter and controller.

37. An ignition system as defined in claim 36 wherein said E-cores for the coil magnetic core are made of laminations and constructed and arranged such that the winding length lp on which the primary winding is wound is ⅕ to ⅓ the winding window length lw, and the distance between the primary winding and the edge of the secondary winding "dps" is as small as practical to provide a suitably low primary leakage inductance Lpe of the generally high leakage inductance of a side-by-side winding and the preferred high primary inductance Lp of at least ten times Lpe.

38. An ignition coil as defined in claim 37 wherein the secondary winding is comprised of a multiple compartment winding made up of 4 to 8 compartments wherein the low voltage compartment is adjacent to the primary winding and the highest voltage compartment is the one furthest away from the primary winding.

39. An ignition as defined in claim 37 wherein the center leg width is between ⅜ and ⅝ inch and winding window length lw is approximately 1.5 inches.

40. An ignition as defined in claim 37 wherein the winding height is between 0.3 and 0.6 inches.

41. An ignition system as defined in claim 36 wherein the coil primary turns Np is approximately 60 and the primary leakage inductance Lpe is approximately 350 uH.

42. A high energy hybrid capacitive/inductive ignition system with one or more coils Ti and with energy storage capacitor means for storing and discharging ignition energy, each coil Ti using unidirectional switches Si which can be controllably turned off with high currents greater than 20 amps flowing through the switch, and high efficiency shunt diode means SDi shunting the primary winding of each respective coil Ti, the ignition system producing an initial quarter cycle capacitive spark with a peak current in the arc discharge of at least 200 ma followed by a longer duration decaying inductive unidirectional spark discharge flowing through shunt switch means SDi, the system powered and controlled by a power converter and controller.

43. An ignition system as defined in claim 42 including a recharge circuit with a recharge capacitor of capacitance Ce and a recharge inductor of inductance Lre to rapidly charge discharge capacitor C following its turn off.

44. An ignition system as defined in claim 43 wherein switches Si are IGBTs.

45. An ignition system as defined in claim 42 wherein said ignition system is a distributor type ignition system with a single coil T of coils Ti and switch S of Si and wherein the topology of the circuit is of Type II with the primary winding of the coil forming a series circuit with the discharge capacitor C and the output of the power converter which is shunted by the switch S.

46. An ignition system as defined in claim 45 wherein switch S has a control switch Sc connected between its control point, i.e. gate, base, or trigger, and ground which is normally on to keep the control point low and switch S off, and wherein switch Sc is turned off and switch S turned on when a trigger signal is received.

47. An ignition system as defined in claim 45 wherein ignition circuit is of topology Type I with the said capacitor means of capacitance C, charged to a voltage Vc, is across the output of said power converter, and wherein said sense voltage Vsense is obtained from the capacitor voltage Vc and conditioned and applied to the inverting input of a pre-control comparator whose non-inverting input is taken to a reference voltage with high hysteresis obtained by connection through a resistor to the output of the comparator, the output of the comparator taken to the control element of a pre-control switch connected between the inverting input and ground of a control comparator which in on when the output of pre-control comparator is high, and vice-versa, the non-inverting input of the control comparator being tied to a reference voltage and its output conneted to the control element of a control switch Sc which is connected to the control elements of the switches Si through diodes to keep the switches Si disabled when no spark firing trigger is supplied or when the capacitor voltage is low, and turn on at least one of switches Si when a trigger signal is received and turn it off when the voltage Vc drops to a prescribed value Vcr.

48. An ignition system as defined in claim 47 wherein Vc is approximately 400 volts and Vcr is approximately 100 volts.

49. An ignition system as defined in claim 45 wherein said switch S is an IGBT.

50. An ignition system as defined in claim 45 wherein said switch S is turned off within less than a quarter period of oscillation.

51. An ignition system as defined in claim 50 wherein voltage sensing is used to turn off the switch S.

52. An ignition system as defined in claim 50 wherein turn off of switch S occurs when the voltage across the capacitor is between 10% and 50% of its initial value Vc.

53. An ignition system as defined in claim 45 wherein ignition circuit is of topology Type I with the said capacitor means of capacitance C being across the output of said power converter, and wherein switches Si have a control switch Sc connected between their control point, i.e. gate, base, or trigger, and ground which is normally on to keep the control points low and switches Si off, and wherein switch Sc is turned off and switches Si are enabled with one or more of them turned on sequentially by other means when a trigger signal is received.

54. An ignition system as defined in claim 53 wherein said other means for turn-on of one or more of switches Si is an octal counter.

55. An ignition system as defined in claim 53 wherein voltage sensing is used to turn off the switches Si.

56. An ignition system as defined in claim 53 wherein turn off of switches Si occurs when the voltage across the capacitor C is between 10% and 50% of its initial value Vc following immediate triggering of the ignition and discharging of said capacitor C.

57. An ignition system as defined in claim 45 wherein voltage sensing is obtained from sensing the voltage at the node between the capacitor and coil primary winding.

58. An ignition system as defined in claim 57 wherein said sensed voltage is conditioned to a value Vsense and is compared with a trigger input generated signal Vtr which upon ignition triggering and spark firing rises to a value above a threshold value Vth of Vsense, whereupon Vsense drops close to ground potential, and then voltage Vtr decays to equal voltage Vsense within the first quarter period of oscillation Tc of the circuit to turn off switch S at some voltage less than the initial voltage Vc to which capacitor C is charged.

59. An ignition system as defined in claim 58 wherein comparison means for comparing voltage levels Vsense and Vtr is an electronic comparator.

60. An ignition system as defined in claim 59 wherein switch S has a control switch Sc connected between its control point, i.e. gate, base, or trigger, and ground which is normally on to keep the control point low and switch S off, and wherein switch Sc is turned off and switch S turned on when a trigger signal is received and the comparator output flips from high to low.

61. An ignition coil for a capacitive discharge spark ignition system with side-by-side windings wherein the primary winding length lp is ⅕ to ⅓ of the core winding window length lw, and the ratio a/b is between 1 and 3, where "a" is the side dimension of a square core or equivalent in which "$a^2$" defines the core area A, and "b" is the winging height averaged between the primary and secondary windings, the coil constructed and arranged such that, in operation, the measured primary coil leakage inductance Lpe is given approximately, i.e. within ±25% of the calculated value of Lpe, by the equation:

$$Lpe=(a/b+1)\cdot lw\sqrt{(Np/10)^2}\ \text{uH}$$

where lw is in units of cms.

62. An ignition system as defined in claim 61 wherein in operation to produce an ignition spark the coil primary has a peak current of approximately 40 amps.

63. An ignition system as defined in claim 61 wherein in operation to produce an ignition spark the peak spark current is approximately 500 ma.

64. An ignition system as defined in claim 61 wherein coil primary winding turns Np are between 30 and 70 and leakage inductance Lpe is between 100 and 600 uH.

65. An ignition system as defined in claim 64 wherein Np is approximately 60 and Lpe is approximately 350 uH.

66. An ignition system as defined in claim 64 wherein the quality factor of the coil Qpe, defined by Qpe=W·Lpe/Rpe, is greater than 5, where W is the angular frequency at 1 kHz and Rpe is the primary coil resistance with the secondary winding shorted.

67. An ignition system as defined in claim 66 wherein the quality factor of the coil Qpe is approximately equal to and greater than 10.

68. An ignition system as defined in claim 61 wherein the core is an E-core.

69. An ignition system as defined in claim 68 wherein the coil made up of core, bobbin, and windings are encapsulated in a housing with the high voltage terminal located and emerging beyond one end of the laminations.

70. An ignition system as defined in claim 68 wherein the core is made up of of laminations.

71. An ignition system as defined in claim 70 wherein the laminations are interleaved.

72. An ignition system as defined in claim 71 wherein laminations are 14 mil silicon iron (SiFe) laminations.

* * * * *